US009138881B2

(12) United States Patent
Caniparoli et al.

(10) Patent No.: US 9,138,881 B2
(45) Date of Patent: Sep. 22, 2015

(54) MULTIPURPOSE TOOL

(75) Inventors: Jeffrey L. Caniparoli, Milwaukie, OR (US); Jeffrey B. Castro, Portland, OR (US); Benjamin C. Rivera, Lake Oswego, OR (US); Blair Scott Barnes, Portland, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 13/460,075

(22) Filed: Apr. 30, 2012

(65) Prior Publication Data

US 2012/0227187 A1 Sep. 13, 2012

Related U.S. Application Data

(62) Division of application No. 12/642,227, filed on Dec. 18, 2009, now Pat. No. 8,166,850.

(51) Int. Cl.

| | |
|---|---|
| ***B25B 7/22*** | (2006.01) |
| ***B25F 1/00*** | (2006.01) |
| ***B25G 1/08*** | (2006.01) |

(52) U.S. Cl.

CPC ..... *B25F 1/003* (2013.01); *B25G 1/085* (2013.01)

(58) Field of Classification Search

CPC ..... B25F 1/003; B25F 1/006; B25F 1/04; B25B 7/02; B25B 7/22; B25G 1/08; B25G 1/10; B25G 1/085

USPC ..... 81/427.5, 890, 177.4, 492, 20–28, 315, 81/490, 423; 7/125, 118, 127–129, 137, 7/144, 165, 167, 127–129

See application file for complete search history.

(56) References Cited

U.S. PATENT DOCUMENTS

| | | | | | |
|---|---|---|---|---|---|
| 329,503 | A | * | 11/1885 | Tateum | 7/129 |
| 445,972 | A | * | 2/1891 | Caldwell | 7/128 |
| 622,197 | A | * | 4/1899 | Bayles et al. | 81/423 |
| 2,539,852 | A | * | 1/1951 | McCoy | 81/315 |
| 4,283,805 | A | | 8/1981 | Stacy | |
| 5,212,844 | A | * | 5/1993 | Sessions et al. | 7/128 |
| 5,416,940 | A | | 5/1995 | Bandera | |
| 5,711,194 | A | | 1/1998 | Anderson et al. | |

(Continued)

OTHER PUBLICATIONS

The Pocket Toolbox™, G10 MaxGrip, Multitasker Ultralight, Multitasker Tools LLC, Brochure, 2 pages.

(Continued)

*Primary Examiner* — Hadi Shakeri
(74) *Attorney, Agent, or Firm* — Alston & Bird LLP

(57) ABSTRACT

A multipurpose tool is provided which may be useful for functions relating to firearms and explosives. The multipurpose tool may include a variety of tools and features while remaining compact. The multipurpose tool may include a blade positioned in a pocket defined between a handle and a body member which define a hook configuration. Elongate members may be rotatably connected to the multipurpose tool and may include a base member with a cam surface and one or more detents which cooperate with a spring follower to hold the elongate member in either or both of an operational position or a storage position. A receiving aperture may be received in a jaw of a pair of pliers, and configured to receive an accessory member. Further, a sleeve may store a bit on the side of a handle and may be retained in the sleeve by a displaceable button.

23 Claims, 16 Drawing Sheets

(56) References Cited

U.S. PATENT DOCUMENTS

| | | | | |
|---|---|---|---|---|
| 5,957,013 | A * | 9/1999 | Frazer | 81/427.5 |
| 6,352,010 | B1 | 3/2002 | Giarritta et al. | |
| 6,594,906 | B1 | 7/2003 | Sakai et al. | |
| 6,860,180 | B1 | 3/2005 | Liao et al. | |
| 7,337,486 | B2 | 3/2008 | Tsuda et al. | |
| 7,401,432 | B2 * | 7/2008 | Perry | 42/108 |
| 7,913,591 | B2 | 3/2011 | Nenadic | |
| 2003/0019045 | A1 | 1/2003 | Ping | |
| 2005/0150334 | A1 | 7/2005 | Knight et al. | |
| 2007/0131069 | A1 * | 6/2007 | Rivera et al. | 7/128 |
| 2009/0090225 | A1 | 4/2009 | Nenadic | |

OTHER PUBLICATIONS

Multi Tools 14-in-1 Hammer Tool [online] [retrieved Jan. 25, 2010]. Retrieved from the internet: <URL: http://greatnecksaw.com/product_info.php?pName=14in1-hammer-tool&cName=all-purpo . . .>. 2 pages.

eFECT™, Specialty Tools, 2010 Gerber Military Product Catalog, Jun. 1, 2009, p. 16.

European Search Report for Application No. EP 10 19 5325 dated Jun. 16, 2014.

* cited by examiner

MULTIPURPOSE TOOL

CROSS REFERENCE TO RELATED APPLICATION

This application is a divisional of U.S. application Ser. No. 12/642,227, filed Dec. 18, 2009, the entire contents of which are hereby incorporated by reference.

FIELD OF THE INVENTION

Embodiments of the present invention relate generally to a multipurpose tool and, more particularly, to a multipurpose tool configured to provide additional features including, in one example, features configured to service a firearm.

BACKGROUND OF THE INVENTION

Multipurpose tools are widely popular for their utility in a substantial number of different applications. As its name suggests, a multipurpose tool includes a number of tools carried by a common frame. A multipurpose tool may include different combinations of tools depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tools that are useful for the intended application. For example, multipurpose tools may be specifically designed for automobile repairs, hunting, fishing or other outdoor applications, gardening and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As noted above, one common tool of a multipurpose tool is a bit driver. A bit driver is advantageously designed to receive a variety of different bits in order to increase the functionality of the multipurpose tool. To facilitate the ease of operation by the user, it would also be desirable for the extra bits, that is, the bits not presently engaged by the bit driver, to be stored and carried by the multipurpose tool so as to be readily available to the user and to avoid loss of the bits. However, it is also desirable for the multipurpose tool to have a compact form such that the storage of the extra bits by the multipurpose tool would desirably not increase the overall size of the multipurpose tool or restrict the capability of the multipurpose tool to assume a compact form.

As multipurpose tools are frequently carried by users in the field, it is desirable for the multipurpose tools to be relatively small and lightweight while remaining rugged so as to resist damage. In order to reduce the overall size of a multipurpose tool, some multipurpose tools have been designed to be foldable. In this regard, foldable multipurpose tools are designed to move between a closed position and an open position. Generally, the closed position is more compact with the multipurpose tool frequently being carried in the closed position. Conversely, while the open position is generally less compact than the closed position, the open position generally allows the deployment of one or more of the tools that are stowed and relatively inaccessible when the multipurpose tool is in the closed position.

For example, a multipurpose tool may include pliers having a pair of jaws connected to respective handles. In the open position, the pliers are deployed and capable of being actuated by movement of the handles toward and away from one another. In the closed position, the handles may be folded about the pliers such that the pliers are no longer functional. In the closed position, however, the multipurpose tool is more compact with the form factor generally defined by the proximal relationship of the handles.

However, it may be desirable for the multipurpose tool to include additional functionality. As such, the present applicant has designed a multipurpose tool having a compact configuration, even in instances in which the multipurpose tool includes additional functionality.

BRIEF SUMMARY OF THE INVENTION

According to one embodiment, a multipurpose tool is provided that includes a plurality of handles comprising a first handle and a second handle configured for relative movement between a closed position and an open position, and a bit driver coupled to the second handle, wherein the bit driver comprises a bit chamber defining an opening configured to receive a bit along an axis. A body member is coupled to the first handle, wherein the body member overlaps with the second handle when the multipurpose tool is in the closed position such that the body member intersects the axis to thereby prevent the bit from falling out of the bit chamber when the multipurpose tool is in the closed position. The body member may define an impact surface configured to withstand impact. The multipurpose tool may further comprise an actuation extension defined by the body member and configured to engage a bolt mechanism of a firearm when the multipurpose tool is in the closed position. A pocket may be defined between the first handle and the body member with a blade, which may be removable, positioned in the pocket. The blade may be at least partially retained in the pocket by a retaining member such as a screw extending at least partially through the blade and at least partially through the first handle or the body member. The multipurpose tool may additionally comprise a carabiner defined at least in part by the first handle and the body member.

In an additional embodiment a multipurpose tool comprises a handle and a bit driver coupled to the handle, wherein the bit driver comprises a bit chamber configured to receive a bit. A bit retention spring is movable between a locking position wherein the bit retention spring is configured to engage a recess in the bit, and a release position wherein the bit retention spring is configured to disengage from the recess, wherein the bit retention spring is integral with the handle. A bit release member may be configured to displace the bit retention spring from the locking position to the release position, wherein the bit retention spring is biased to the locking position. The bit release member may also be integral with the handle.

In a further embodiment a multipurpose tool comprises a plurality of handles comprising a first handle and a second handle configured for relative movement between a closed position and an open position, a plurality of tools carried by at least one of the handles, and a pair of pliers defined by a first jaw coupled to the first handle and a second jaw coupled to the second handle. A receiving aperture is defined in the first jaw, and an opening in the second handle is configured to align with the receiving aperture when the multipurpose tool is in the closed position, wherein the receiving aperture is configured to receive an accessory member such as a barrel cleaning rod. The pair of pliers may define a crimping aperture between the first jaw and the second jaw.

Additional embodiments of a multipurpose tool comprise a plurality of handles comprising a first handle and a second handle configured for relative movement between a closed position and an open position, the first handle comprising a projection defining a sleeve on a first side of the first handle, wherein the sleeve defines a longitudinal axis, and wherein the sleeve is configured to receive a removable bit along the longitudinal axis. A bit stop is positioned along the longitudinal axis and configured to limit travel of the removable bit. The multipurpose tool may further comprise a displaceable button configured to selectively limit movement of the removable bit in the sleeve along the longitudinal axis, wherein the displaceable button is moveable between a retracted position wherein movement of the removable bit along the longitudinal axis is allowed and an extended position wherein movement of the removable bit along the longitudinal axis in the second axial direction is limited.

The multipurpose tool may further comprise a second sleeve coupled to a second side of the first handle substantially opposite to the first side and configured to receive a second removable bit, wherein the second sleeve defines a second longitudinal axis substantially parallel with the longitudinal axis. The displaceable button may be configured to limit movement of the second removable bit along the second longitudinal axis when the displaceable button is in the retracted position and the extended position and allow movement of the second removable bit along the second longitudinal axis when the displaceable button is in a second extended position. A spring may comprise a first prong configured to selectively engage a first inner groove and a first outer groove defined in the displaceable button, and a second prong configured to selectively engage a second inner groove and a second outer groove defined in the displaceable button, wherein the first prong engages the first inner groove and the second prong engages the second inner groove when the displaceable button is in the extended position. The first prong engages the first outer groove when the displaceable button is in the retracted position, and the second prong engages the second outer groove when the displaceable button is in the second extended position. A clip may be coupled to the first handle, wherein the clip defines a bit aperture substantially coaxial with the longitudinal axis, and wherein the bit aperture is configured to receive the removable bit during insertion of the removable bit into the sleeve. A button cutout may be defined by the clip, wherein the button cutout is configured to facilitate access to the displaceable button.

A further embodiment of a multipurpose tool comprises a handle and a handle cover coupled to the handle, wherein the handle cover defining a longitudinal channel configured to receive a removable bit. The handle cover and the removable bit thereby collectively define a handgrip when the removable bit is received in the longitudinal channel. The handle cover may comprises at least one finger extending into the longitudinal channel, wherein the finger is configured to engage the removable bit to selectively retain the removable bit in the longitudinal channel. In some embodiments the handle comprises a tang displaced from a corresponding aperture in the handle and extending at an angle outwardly from the handle, wherein the handle cover comprises a recess configured to receive the tang to thereby at least partially couple the handle cover to the handle.

In a further embodiment a multipurpose tool comprises a plurality of handles including a first handle and a second handle configured for relative movement between a closed position and an open position, a plurality of tools carried by at least one of the handles, and a latch coupled to the first handle. The latch is configured to deflect to releasably engage the second handle when the first handle and the second handle are in the closed position to selectively retain the multipurpose tool in the closed position. The latch may comprise a bent piece of metal which defines an end tab configured to engage the second handle when the multipurpose tool is in the closed position. Further, the latch may pivot about a retaining member which holds one of the tools to the first handle.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
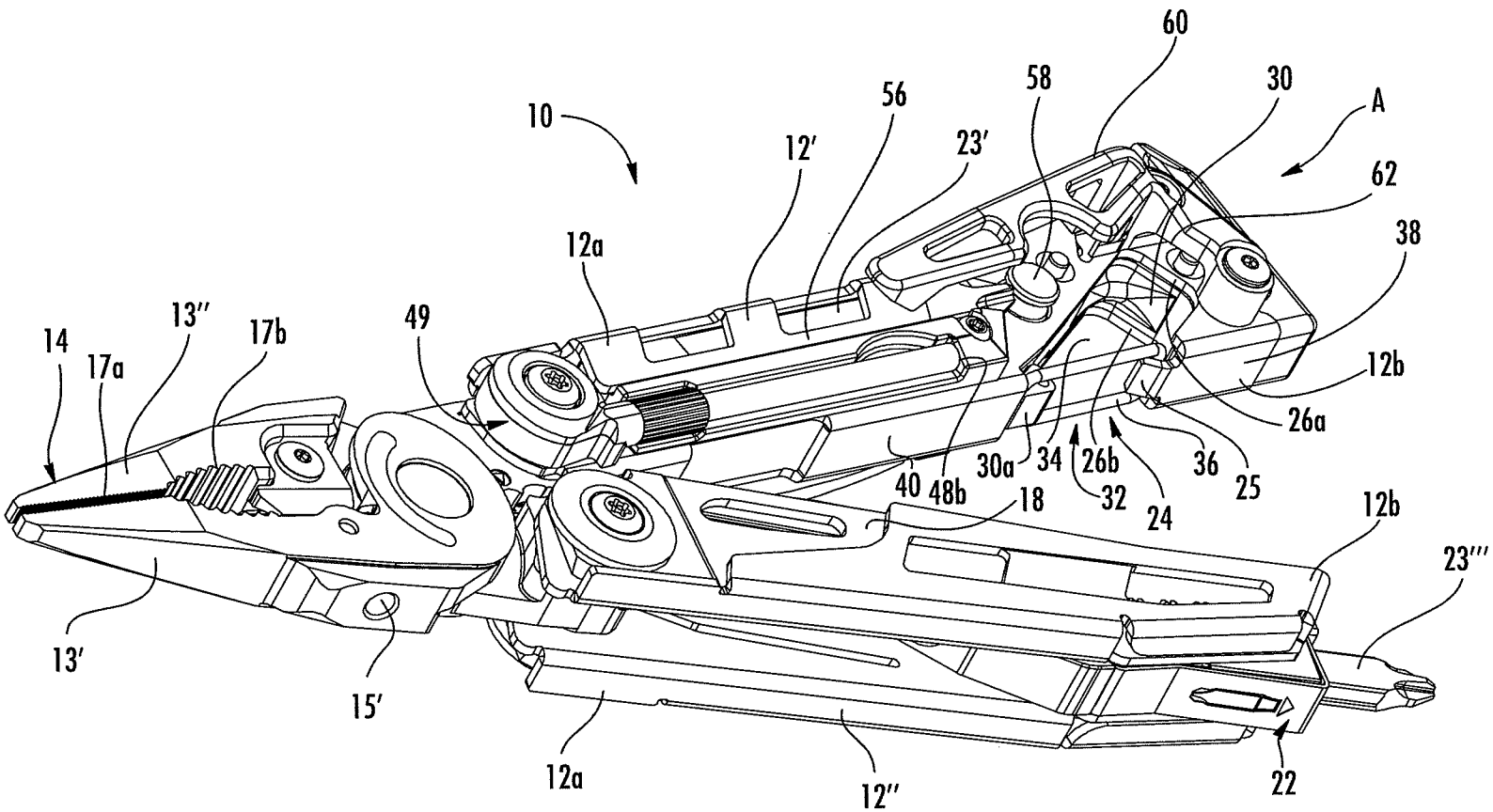
FIG. 1 illustrates a perspective view of side A of an embodiment of a multipurpose tool comprising regular pliers and an elongate member with a blunt end surface, wherein the multipurpose tool is in an open position.

Referring now to FIG. 1, a multipurpose tool 10 according to one embodiment of the present invention is depicted. The multipurpose tool includes a plurality of handles 12 configured for movement relative to one another, as well a plurality of tools carried by at least one of the handles. Typically, the multipurpose tool includes a pair of generally elongate handles 12 that extend between opposed ends 12*a*, 12*b*. As a result of their connection, such as a pivotal connection, to one another and/or to one or more of the tools, the handles can be moved toward and away from one another, such as in order to actuate a tool as described below.

Figure 2:
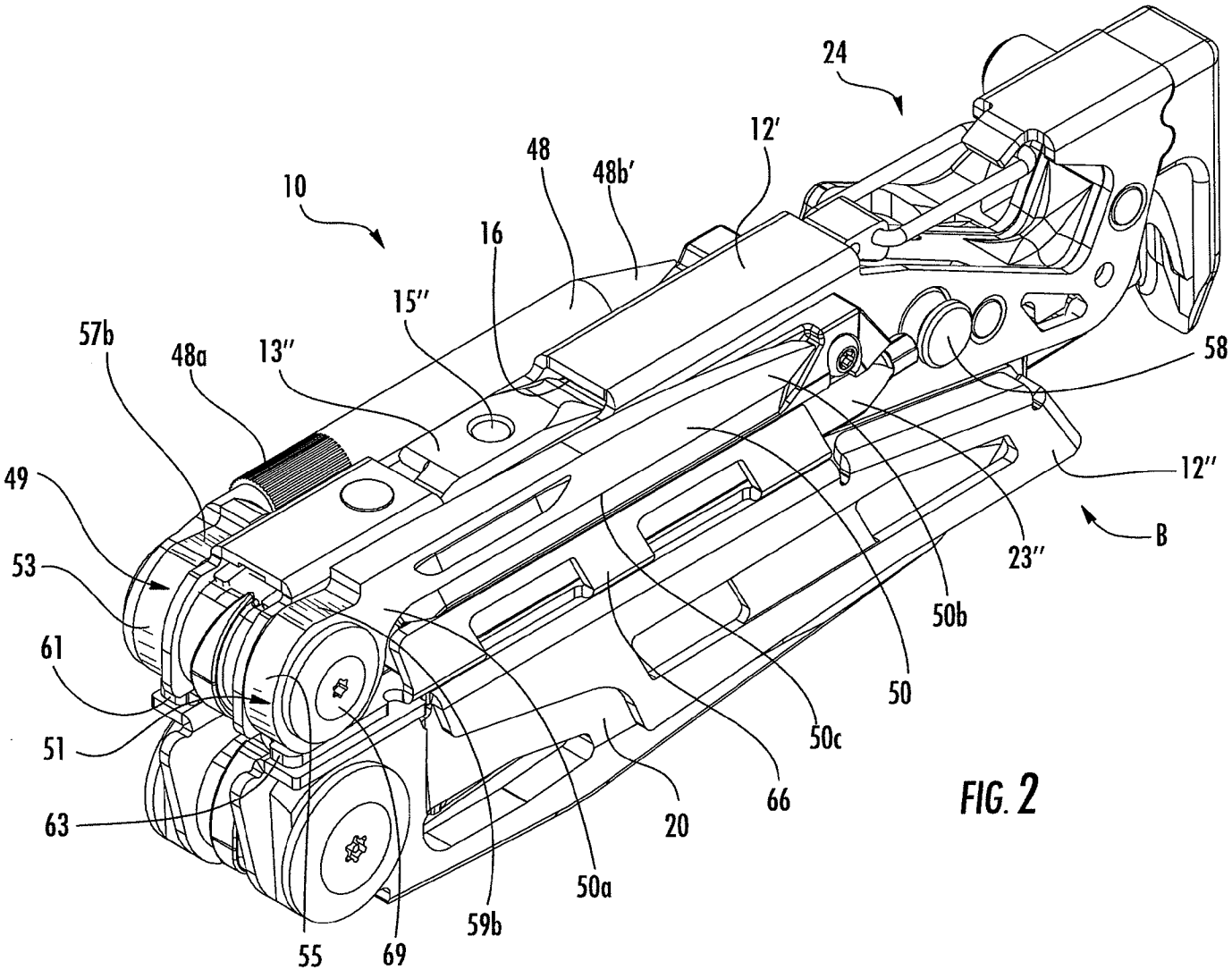
FIG. 2 illustrates a perspective view of side B of an embodiment of the multipurpose tool of FIG. 1 comprising a tip at a distal end of the elongate member, wherein the multipurpose tool is in a closed position.

As also described below, the multipurpose tool 10 may be configured such that the handles 12 are adapted for relative movement between an open position as shown in FIG. 1 and a closed position as shown in FIG. 2 and discussed hereinafter. As will be apparent, the multipurpose tool 10 has a compact form factor in the closed position so as to facilitate transport and storage of the multipurpose tool. While the multipurpose tool 10 is more expansive in the open position, one or more of the tools of the multipurpose tool are accessible and capable of being utilized in the open position, even though those same tool(s) are stowed and generally inaccessible in the closed position.

With reference to FIG. 1, the multipurpose tool 10 may include first 12' and second 12" handles that are respectively connected to the opposed first jaw 13' and second jaw 13" of a tool 14 which may together define a pair of pivotable pliers. In particular, the embodiment of the tool 14 illustrated in FIG. 1 includes needle nose pliers 17*a* and regular pliers 17*b*. In the open configuration, the handles 12 may be moved toward one another to a position shown in FIG. 1 in order to close the jaws 13 of the pliers and away from one another in order to open the jaws of the pliers. The tool 14 may further comprise receiving apertures 15', 15" defined in one or both of the jaws 13. The receiving apertures 15 may be configured to receive an accessory member. For example, the receiving apertures 15 may be threaded to receive and engage a barrel cleaning rod used to clean the barrel of a firearm, although various other accessory members may be received by the receiving aperture, and various other types of connectors may be employed.

Regardless of the type of accessory member received in the receiving apertures 15, the multipurpose tool 10 may be securely gripped by the user in order to use the accessory member. In particular, as illustrated in FIG. 2, an opening 16 may be defined in one of the handles 12 and configured to align with a corresponding receiving aperture 15 when the multipurpose tool 10 is in the closed position. For example, in the illustrated embodiment, a receiving aperture 15" is defined in the second jaw 13", and thus when the first handle 12' is pivoted to the closed position, the receiving aperture is accessible through the opening 16 in the second handle. Alternatively or additionally a receiving aperture may be defined in the first jaw and accessible through an opening defined in the second handle. Thus, the multipurpose tool may function as a handle when an accessory member is received and engaged by the receiving aperture, which may thereby facilitate use of the accessory member.

Figure 3:
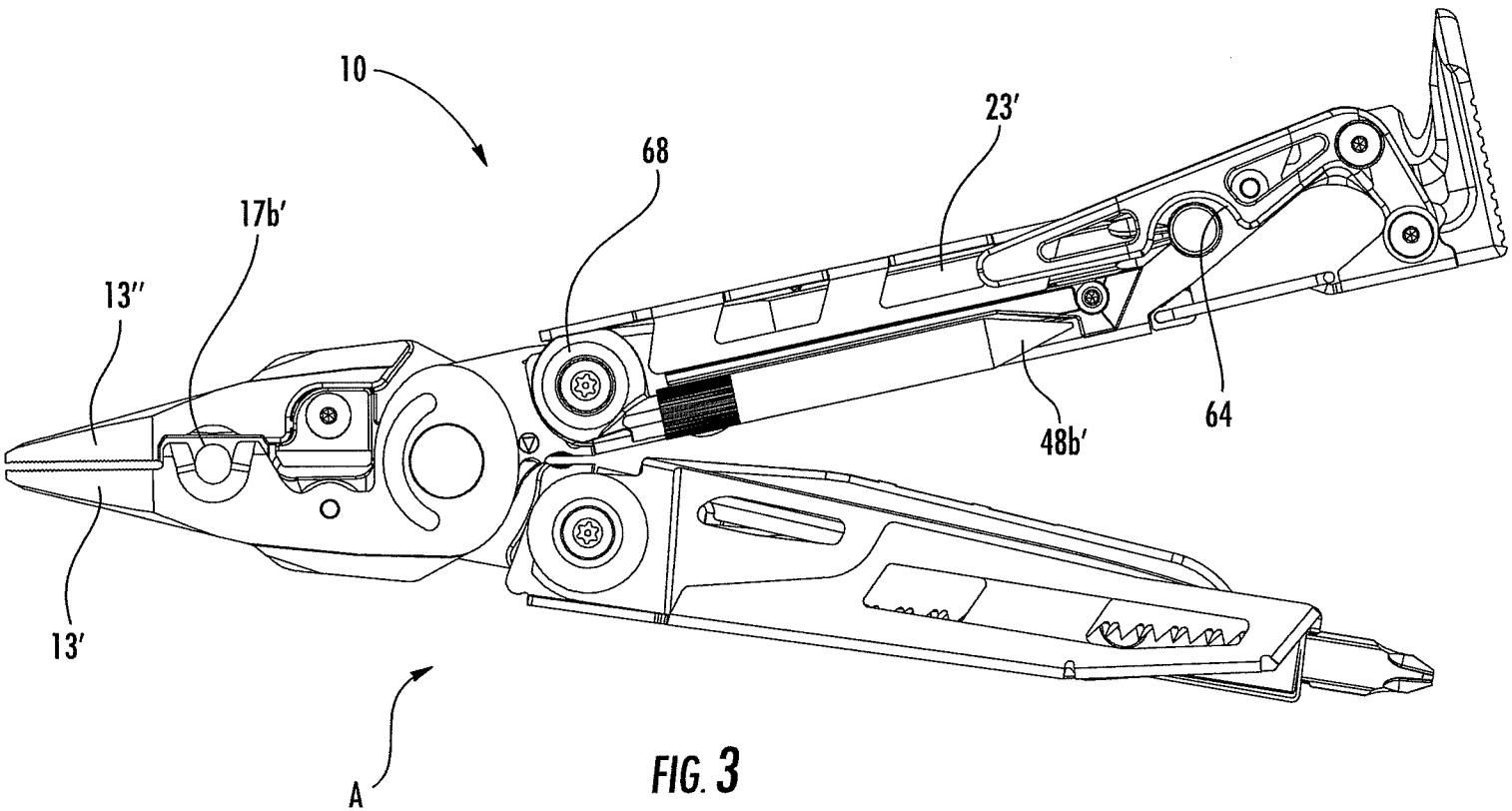
FIG. 3 illustrates a view of side A of the multipurpose tool of FIG. 2, which further comprises a crimping aperture, wherein the multipurpose tool is in the open position.

Further, as illustrated in FIG. 3, the multipurpose tool 10 may include a crimping aperture 17*b'* defined between the first jaw 13' and the second jaw 13" of the pliers instead of the regular pliers. The crimping aperture 17*b'* may be sized and shaped to crimp a blasting cap useable for insertion into C4 or other explosives for demolition purposes. Thus, the multipurpose tool 10 may comprise features which are useful for demolition experts.

In one embodiment, the jaws 13', 13" of the pliers are configured to contact one another once the jaws are in a fully opened position in order to prevent further opening of the jaws. Even though the jaws 13', 13" cannot be opened any further, the handles 12 can be pivoted relative to the respective jaws in order to transition from the open position as shown in FIG. 1 to the closed position as shown in FIG. 2. Although the handles may be connected to the jaws in a variety of different manners, the pivotable connection between the handles and jaws may incorporate a camming mechanism in order to bias the handles to remain in either the open or closed positions. The camming mechanism incorporated into the pivotable connection between the handles and the jaws may thereby reduce the unlikelihood that the multipurpose tool will be inadvertently transitioned between the open and closed positions.

The multipurpose tool 10 can include a variety of tools. Although not heretofore described, the pliers can also include wire cutters and/or wire strippers, if desired. Additionally, the multipurpose tool 10 of one embodiment includes a knife blade 20 (see FIG. 2) and a bit driver 22 (see FIG. 1) carried by one of the handles 12. One of the handles may also carry a saw blade and/or other tools, such as a bottle opener, can opener, file, razor, gut hook or the like. With reference to the illustrated embodiment, the knife blade 20 can be pivotally connected to one of the handles 12 so as to be unfolded to a deployed position, particularly in instances in which the multipurpose tool 10 is in the closed configuration. Additionally, the bit driver 22 defines a bit chamber 22*a* that is sized and shaped to snugly receive corresponding bits 23, such as the Philips head screwdriver bit 23''' which is illustrated as received in the bit driver. As shown, the bit driver 22 may be defined in one end 12*b* of one of the handles 12, such as the end of the second handle 12" opposite the pivotable connection with the jaws 13', 13". The bit driver 22 may receive a wide variety of bits 23 including screwdriver bits, torx bits, hex bits, Robertson bits, etc.

Figure 4:
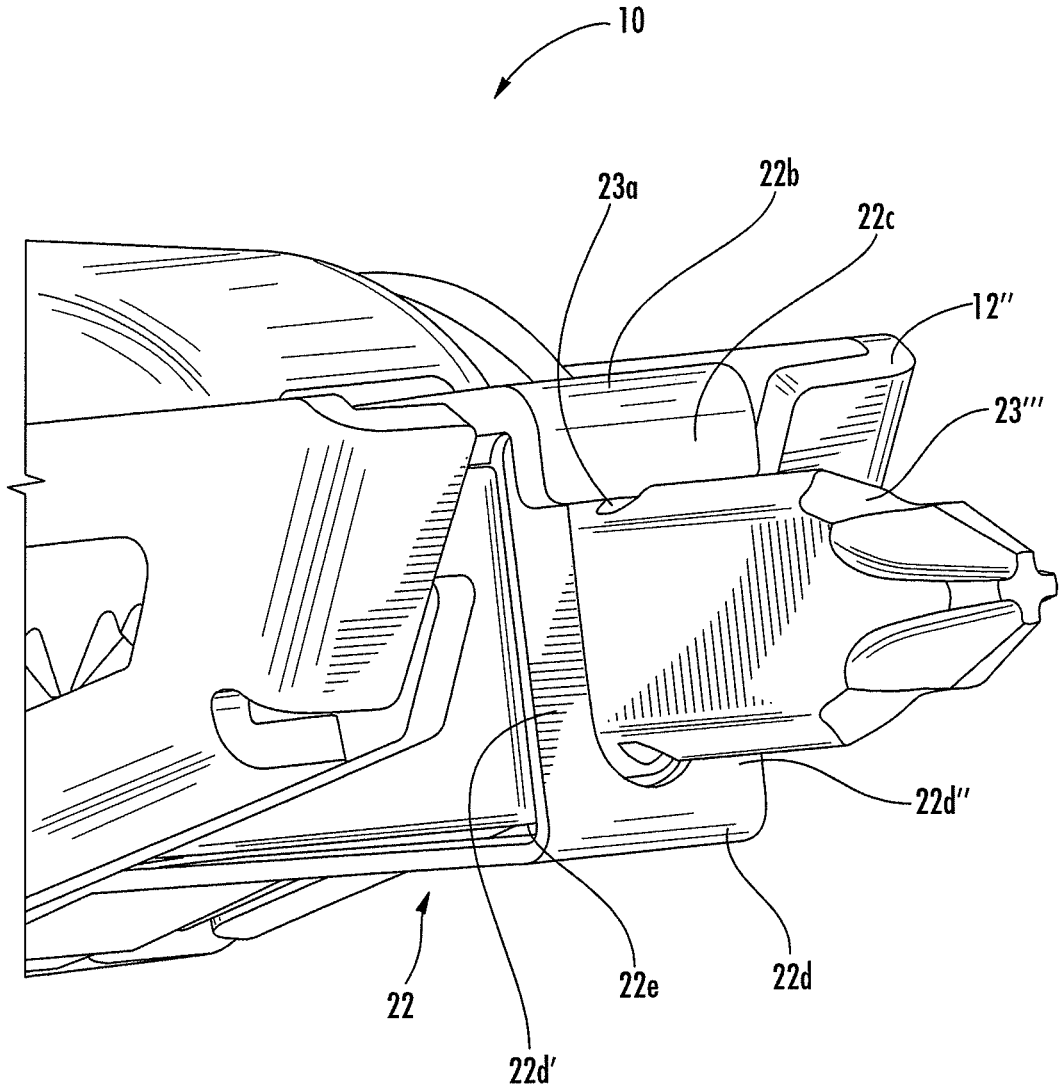
FIG. 4 illustrates an enlarged perspective view of the bit driver of the multipurpose tool according to one embodiment of the present invention.
Figure 5:
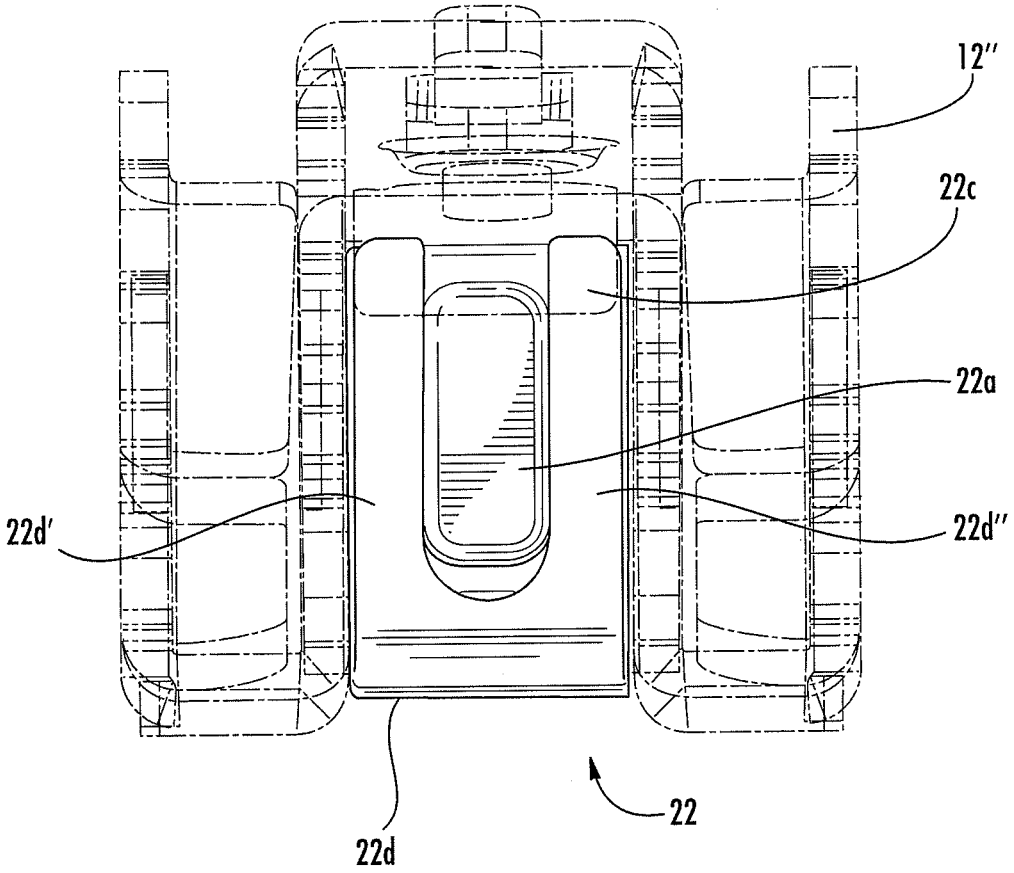
FIG. 5 illustrates an enlarged end view of the bit driver of FIG. 4 with the bit removed.

In some embodiments the bit driver 22 may comprise features which allow the user to selectively retain a bit 23 in the bit driver and release the bit. For example, FIGS. 4 and 5 show an embodiment of the multipurpose tool 10 comprising a bit retention spring 22*b*. The bit retention spring 22*b* comprises a catch 22*c*, which may comprise an integral bent portion of the bit retention spring. The catch 22*c* is configured to engage a recess 23*a* in the bit 23''' when the bit retention spring is in a locking position, as illustrated. However, when the bit retention spring 22*b* is displaced from the locking position to a release position wherein the catch 22*c* is lifted from the recess 23*a*, the bit 23''' may be removed from the bit chamber 22*a*. The bit retention spring 22*b* may be biased to the locking position such that the catch 22*c* will tend to overlap with the opening of the bit chamber 22*a* when no force is applied to the bit retention spring, as illustrated in FIG. 5.

The multipurpose tool 10 may further comprise a bit release member 22*d* configured to displace the bit retention spring 22*b* from the locking position to the release position. As illustrated in FIG. 4, the bit release member 22*d* is spring loaded and opposes the bit retention spring 22*b*. In particular, the bit release member 22*d* is positioned on an opposite side of the bit driver 22 and comprises first 22*d'* and second 22*d"* prongs. As a result of leaving a gap 22*e* between the bit release member 22*d* and the body of the bit driver 22, the bit release member may be displaced by the user toward the bit retention spring 22*b* such that the first 22*d'* and second 22*d"* prongs displace the bit retention spring. Thereby the catch 22*c* is displaced from the recess 23*a* as the bit retention spring 22*b* is moved to the release position. Accordingly, the user may thereby remove the bit 23'''. However, many different embodiments of bit release members may be used. For example, the bit release member may alternatively comprise an integral part of the bit retention spring. Thus, the bit release member could comprise one or more extensions of the catch 22*c* extending on one or both sides of the bit 23''', which could be depressed by the user to release the bit.

Figure 6:
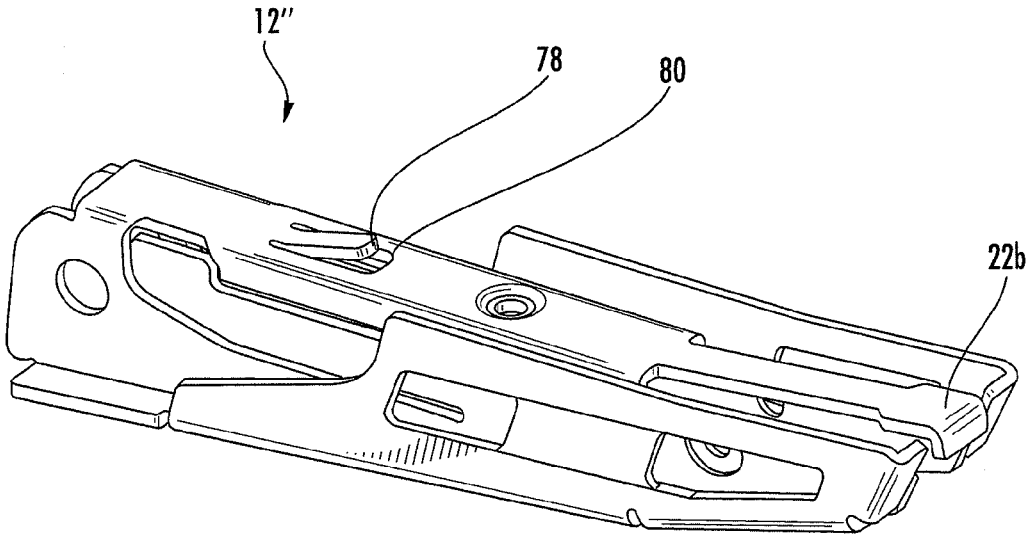
FIG. 6 illustrates the second handle of the multipurpose tool according to one embodiment of the present invention.

In some embodiments either or both of the bit retention spring 22*b* and the bit release member 22*d* may be integral with the handle holding the bit driver 22. For example, in the illustrated embodiment the bit retention spring 22*b* is integral with the second handle 12'', as illustrated in FIG. 6. However, in alternate embodiments the bit release member may additionally or alternatively be integral with the handle. By integrating one or both of the bit retention spring and the bit release member with the handle, the number of parts forming the multipurpose tool may be reduced, which may provide benefits in terms of reduced complexity, weight, and/or cost of the multipurpose tool.

As illustrated in FIG. 1, the multipurpose tool 10 may also include a carabiner 24 for permitting the multipurpose tool to be removably secured to another object, such as a belt loop, key ring or the like. The carabiner 24 is configured to move in concert with one of the handles 12 and is typically formed by the respective handle, such as at one end 12*b* thereof. The carabiner 24 is typically formed, not by the second handle 12'', which carries the bit driver 22, but instead by the first handle 12'.

The carabiner 24 includes first 26*a* and second 26*b* sidewalls that are spaced from one another. The first 26*a* and second 26*b* sidewalls also generally define a portion of the first handle 12', such as a frame, so as to permit the handle including the carabiner 24 to be fabricated in an efficient manner. Thus, the carabiner 24 moves in concert with the first handle 12' and is generally not movable relative to the remainder of the handle, i.e., is incapable of movement independent of the remainder of the handle. As shown, the first 26*a* and second 26*b* sidewalls are spaced apart from one another such that at least portions of the first and second sidewalls define a gap therebetween which may be partially or completely filled by a body member 30, as will be described below.

The carabiner 24 defines an opening 32 into an engagement aperture 34 with the engagement aperture being accessible through both the first 26*a* and second 26*b* sidewalls. In this regard, the object to which the multipurpose tool 10 is desirably attached may be inserted through the opening 32 into the engagement aperture 34 such that the carabiner 24 is effectively clipped to the object. In order to secure the object within the engagement aperture 34, the carabiner 24 can also include a gate 36 that extends across the opening 32 defined by the carabiner. While the carabiner 24 can include a variety of gates, the carabiner of one embodiment includes a gate 36 that is pivotally connected, at one end, to the body member 30, as illustrated. In this regard, the gate 36 may be spring loaded so as to close the opening 32 in the absence of any applied force. Although the gate 36 can be pivotally connected to the body member 30 in various manners, the gate of the illustrated embodiment is a rectangular hoop that is pivotally connected to a first extension 30*a* of the body member 30. Alternatively, the gate 36 could pivotally connect to the first handle 12' directly.

Although the first 26*a* and second 26*b* sidewalls are spaced from one another, one or more portions of the first and second sidewalls may be interconnected. For example, portions of the first 26*a* and second 26*b* sidewalls proximate the opening 32 defined by the carabiner 24 may be interconnected as indicated by interconnect 38. Medial portions of the first 26*a* and second 26*b* sidewalls may also be interconnected with interconnect 40, albeit at some distance spaced apart from the carabiner 24. However, other portions of the first and second sidewalls may be free of any direct connection.

While the carabiner 24 may have various orientations relative to the first handle 12' and, in turn, relative to the multipurpose tool 10, the carabiner of the illustrated embodiment is configured such that the opening 32 defined by the carabiner faces inwardly, i.e., faces toward the second handle 12'', in instances in which the multipurpose tool is in the open position as shown in FIG. 1. As such, the transition of the multipurpose tool 10 from the open position to a closed position as shown in FIG. 2 repositions the carabiner 24 such that the opening 32 defined by the carabiner now faces outwardly, i.e., faces away from the second handle 12'', so as to be more easily accessed by the user.

Figure 7:
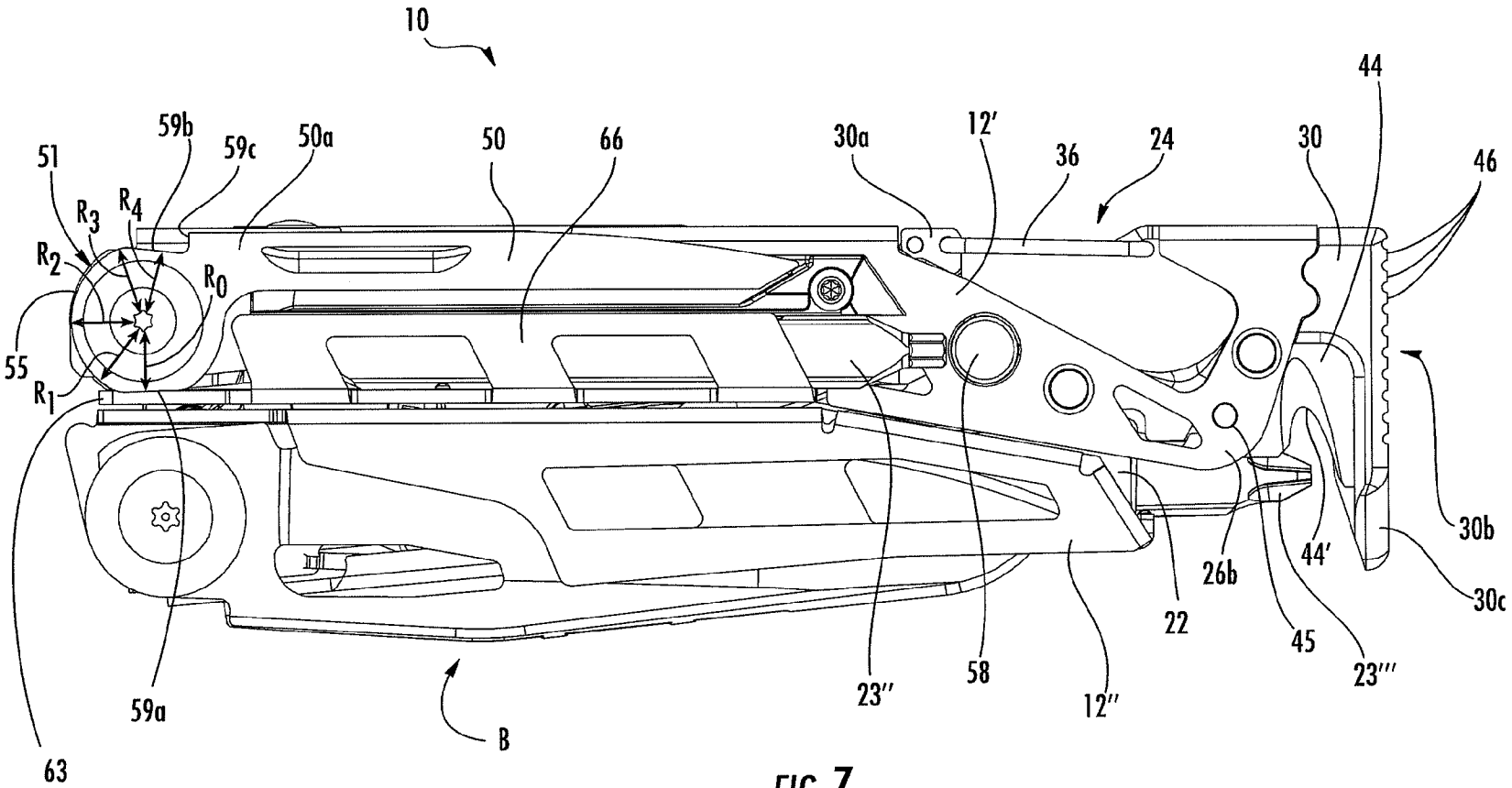
FIG. 7 illustrates side B of the multipurpose tool of FIG. 1 in the closed position with the second elongate member in the storage position.
Figure 8:
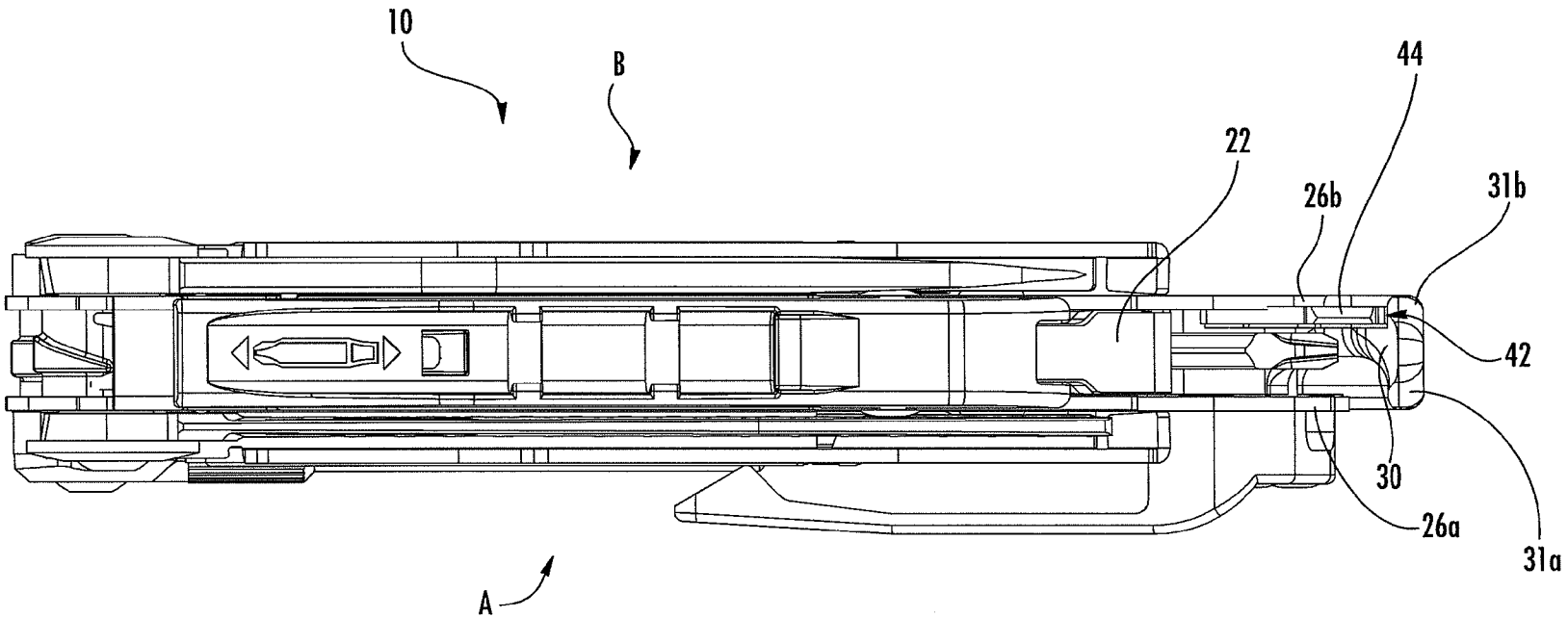
FIG. 8 illustrates an edge view of the multipurpose tool of FIG. 2 in the closed position.

Further, in order to reduce the form factor of the multipurpose tool 10 in the closed position, the carabiner 24 may be configured such that a tool carried by the second handle 12'', that is, the handle not carrying the carabiner, is at least partially disposed within the carabiner between the first 26*a* and second 26*b* sidewalls when the handles 12 are in the closed position. As shown in FIGS. 7 and 8, for example, the bit driver 22 is at least partially disposed within the carabiner 24 between the first 26*a* and second 26*b* sidewalls when the multipurpose tool 10 is in the closed position. As such, the resulting configuration of the multipurpose tool 10 is more compact than if the bit driver 22 did not fold at least partially within the carabiner 24.

As shown in FIG. 1, the carabiner 24 may also include an integral bottle opener. For example, the carabiner may include an inwardly turned lip 25 proximate the opening 32 defined by the carabiner. For example, the lip 25 may be a portion of or proximate to interconnect 38. In order to open a bottle, the bottle cap may be inserted through the opening 32, thereby displacing the gate 36, such that the lip engages the bottle cap and permits the transfer of force thereto by the user.

The first handle 12' and the above-mentioned body member 30 may provide additional functionality to the multipurpose tool 10. As illustrated in FIGS. 7 and 8, the body member 30 may be connected to one or both of the first 26*a* and second 26*b* sidewalls of the first handle 12' by being inserted therebetween. The first handle 12' and the body member 30 may thereby define a hook configuration (see, e.g. FIG. 7) comprising a pocket 42 (see FIG. 8) defined between the first handle and the body member. A blade 44 may thereby be positioned and supported within the pocket 42, and may be removable from the pocket (see FIG. 12). The blade 44 may comprise a single piece of metal or other material, or may alternatively comprise a multipiece assembly. When the blade 44 is removable, a retaining member, such as a screw or other similar device may extend at least partially through the blade and at least partially through the first handle 12' or the body member 30. For example, a screw may extend through a hole 45 (see FIG. 7) defined in the second sidewall 26*b* of the first handle 12' to retain the blade 44 in the pocket 42.

The blade 44 may define a hook shaped edge 44', although other edge and blade shapes are possible. As a result of the body member 30 and the first handle 12' cooperating to define a hook configuration, and the blade 44 also optionally defining a hook shaped edge 44', the multipurpose tool 10 may be configured to hook and cut various objects. For example, the hook configuration may be particularly useful for cutting rope, zip ties, and other objects which may be brought into contact with the blade 44. In this regard, it is notable that the hook configuration defined by the body member 30 and the first handle 12' may provide a safety function in that the blade 44 is partially shielded by the body member and/or the first handle such that inadvertent contact with the blade may be avoided.

As illustrated in FIG. 7, the body member 30 includes an extension 30*a* which retains the gate 36 of the carabiner 24. The body member 30 may also define an impact surface 30*b* configured to withstand impact. Thus, the multipurpose tool 10 may be used to hammer nails, stakes, and other objects. By retaining the body member 30 within the first 26*a* and second 26*b* sidewalls of the first handle 12', the body member and the impact surface 36*b* may be configured to withstand impact. In particular, as illustrated in FIG. 8, first 31*a* and second 31*b* overhanging portions of the body member 30 may overlap with the first 26*a* and second 26*b* sidewalls such that the first handle 12' supports the body member, which may provide strength to the multipurpose tool 10 which helps the body member to withstand impact.

As illustrated in FIG. 7, the body member 30 may also define an actuation extension 30*c*. The actuation extension may define a member which protrudes generally perpendicularly to the handle 12' to which it is attached. The actuation extension 30*c* may be useful as a lever or hook for manipulating various objects. For example, the actuation extension 30*c* may be configured and used to engage a bolt mechanism of a firearm such as when the firearm jams. In terms of this configuration, the actuation extension 30*c* may generally taper to a rounded tip. Various other uses as would be known by one having skill in the art are also possible. Further, a portion of the body member 30 such as the actuation extension 30*c* may overlap with second handle 12" such that the body member intersects the axis along which the bit driver 22 receives bits 23 when the multipurpose tool 10 is in the closed position, as illustrated. As a result of this overlap, the bit 23'" may be prevented from falling out of the bit chamber 22*a* of the bit driver 22 even during extreme hammering using the impact surface 30*b* of the multipurpose tool when the multipurpose tool 10 is in the closed position. Such a configuration also allows the actuation extension 30*c* to generally overlap with the second handle 12" when the multipurpose tool is in the closed position, such that the multipurpose tool defines a relatively compact configuration.

Use of the actuation extension 30*c* and/or the blade 44 may be facilitated by providing the impact surface 30*b* with one or more grip enhancing elements, such as ribs 46, configured to enhance friction during use of the multipurpose tool 10. For example, when using the multipurpose tool 10, the user may grasp the multipurpose tool such that the user positions his thumb on the ribs 46 on the impact surface 30*b* to enhance grip in some situations. Further, the ribs 46 may help prevent the impact surface 30*b* from slipping off of an object when the multipurpose tool 10 is being used as a hammer on the object as described above.

As illustrated in FIG. 2, the multipurpose tool 10 may additionally comprise one or more elongate members 48, 50 coupled to respective base members 49, 51 at respective proximal ends 48*a*, 50*a* of the elongate members. One or both of the elongate members 48, 50 may be configured to be removable from the base members 49, 51 such as through a threaded connection, or the elongate members may be integral with the base members. When the elongate members 48, 50 are removable, they may include a textured surface configured to provide a user with sufficient grip to remove or attach the elongate members, depending on the type of connection used to secure the elongate members to the respective base members 49, 51. For example, the first elongate member 48 is provided with splines at the proximal end 48*a* which facilitate a threaded connection between the first elongate member and the first base member 49. When an elongate member 48, 50 is integral with a respective base member 49, 51, as is the case with the illustrated second elongate member, the entirety of the elongate member and base member may be removed by removing a respective end screw 68, 69. One of the end screws 68, 69 may secure to a pin member with a stepped shoulder portion within the multipurpose tool 10, wherein the stepped shoulder portion is configured to retain the remainder of the tools and other components attached to the pin (other than the respective elongate member 48, 50) even when the respective end screw is removed. Further, when the elongate members 48, 50 are removable from the respective base members 49, 51, other tools may be connected to the base members. Thus, a user may select the type of tools connected to the base members depending on the type of use the multipurpose tool 10 will serve.

The base members 49, 51 are in turn connected to respective handles 12, which may comprise either of the first handle 12' or the second handle 12". Each base member 49, 51, comprises a cam surface 53, 55 and may further comprise one or more detents 57, 59. Spring followers 61, 63, may be defined by the handles 12', 12". For example, the spring followers 61, 63 may comprise cantilevered portions of the handles 12', 12". The spring followers 61, 63 are configured to contact the respective cam surfaces 53, 55 as the base members 49, 51 rotate about respective axes in order to extend the elongate members 48, 50 to operational positions from storage positions, as will be explained below. The axes about which the elongate members 48, 50 rotate may be common with one or both of the axes about which the handles 12 rotate.

In the illustrated embodiment, the first elongate member 48 comprises a punch which may comprise a blunt surface 48*b* (see, e.g. FIGS. 1 and 11) or a sharpened tip 48*b'* (see, e.g. FIGS. 2 and 3) at a distal end. The first elongate member 48 may be used to create holes in various objects or may be used to manipulate objects which may otherwise be difficult to access, such as certain internal parts of a firearm. In particular, when the first elongate member 48 has a blunt surface 48*b*, the first elongate member may be useful to disassemble a firearm. In terms of creating holes, the first elongate member 48 may be useable to punch a hole in an explosive such as C4, in order to insert a blasting cap therein during preparation of explosives for demolition, particularly when the first elongate member comprises a sharpened tip 48*b'*. The second elongate member 50 may comprise a blade edge 50*c* extending at least partially between the proximal end 50*a* and a distal end 50*b* of the of the second elongate member. The second elongate member 50 may thus be useful for scraping or other similar functions. In particular, the second elongate member 50 may comprise a material which is relatively softer than the material forming the object being scraped, such as a second elongate member 50 formed of bronze or a bronze alloy for scraping a bolt mechanism or other portion of a firearm formed of steel or the like. The second elongate member 50 may thereby be useful to scrape carbon buildup off of the bolt mechanism or other component substantially without damaging the firearm, and may thereafter be replaced when needed, as described above. However, various other uses of the elongate members 48, 50 and various other types of elongate members would be known by one having skill in the art.

Movement of the elongate members will now be described with respect to the second elongate member 50, though movement of the first elongate member 48 will be substantially similar. Referring to FIG. 7, which illustrates the second elongate member 50 in a storage position, the base member 51 may comprise first 59*a* and second 59*b* detent members on either sides of the cam surface 55. When the second elongate member 50 is in the storage position, the second elongate member is folded such that the multipurpose tool 10 defines a compact configuration. In this position, the spring follower 63 engages the first detent 59*a* , which thereby provides a force on the base member 51 which tends to retain the second elongate member 50 in the storage position.

However, when the user wants to use the second elongate member 50, the user will grasp the second elongate member in order to rotate the second elongate member in a first direction. In doing so, this will cause the base member 51 to also rotate in the first direction. Thereby, the spring follower 63 will come out of contact with the first detent 59*a* and begin contacting the cam surface 55. The cam surface 55 may comprise a first radius $R_1$ which is greater than a first detent radius $R_0$. Accordingly, the spring follower 63 must be displaced further in order to rotate the base member 51 such that the first detent 59*a* comes out of contact with the spring follower. This additional force may tend to avoid accidental opening of the second elongate member 50. Once the spring follower comes into contact with the cam surface 55, the spring force may remain constant if the second radius $R_2$ and third radius $R_3$ further defined by the cam surfaces 55 are equal to the first radius $R_1$. Alternatively, the second radius $R_2$ may be less than the first radius $R_1$ and the third radius $R_3$, and thus the effort required to rotate the second elongate member 50 will initially be reduced, but then will increase as the third radius along the cam surface 55 comes into contact with the spring follower 63. Finally, the spring follower 63 will come into contact with the second detent 59*b* when the second elongate member 50 reaches the operational position, as shown in FIG. 9.

When in the operational position, the second elongate member 50 may be prevented from rotating further in the first direction by contact between a stop surface 59*c* and the spring follower 63 in a direction whereby the spring follower substantially resists displacement, such as perpendicular to the direction whereby the spring follower applies a force to the second detent 59*b*. The stop surface 59*c* may be defined by the proximal end 50*a* of the second elongate member, or may alternatively be defined by the base member 51.

Figure 9:
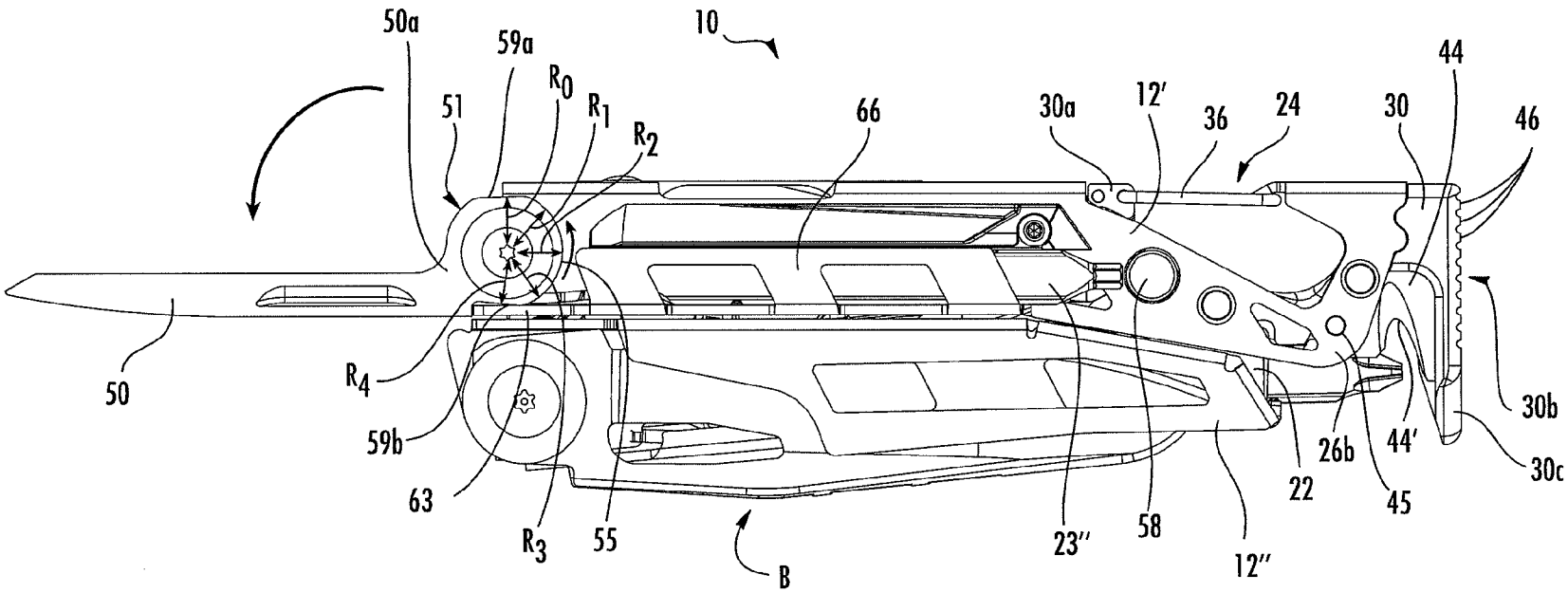
FIG. 9 illustrates side B of the multipurpose tool of FIG. 7 with the second elongate member in the operational position.
Figure 10:
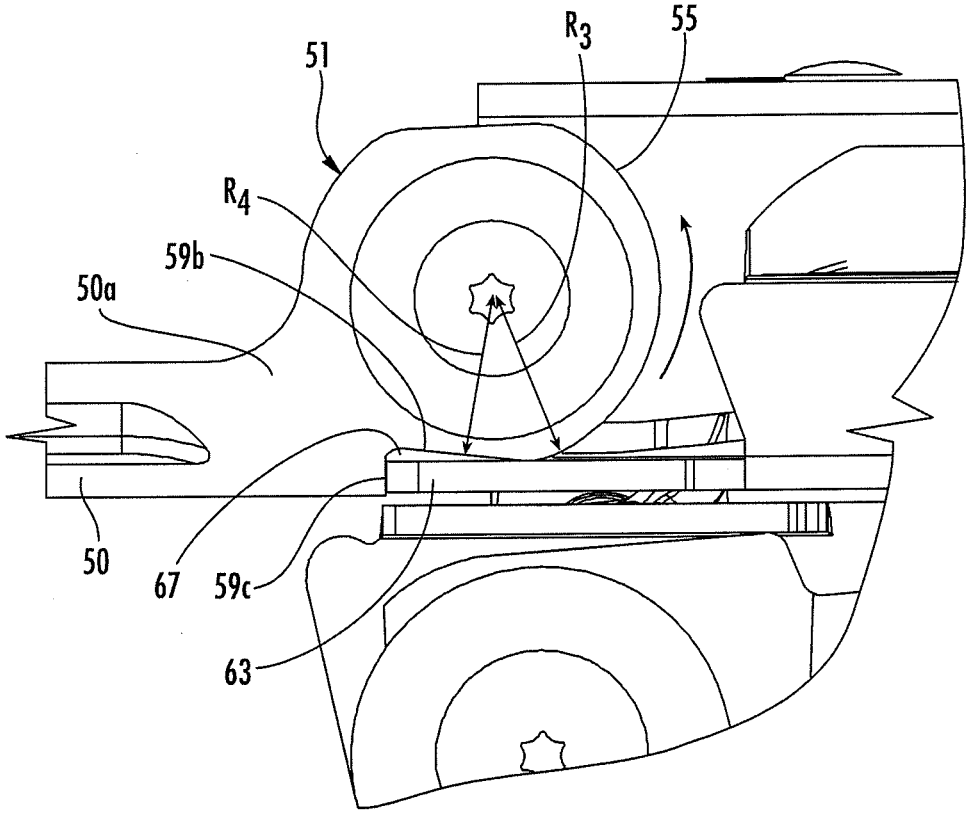
FIG. 10 illustrates an enlarged portion of FIG. 9.

As shown in FIG. 10, which illustrates an enlarged section of FIG. 9, a gap 67 may be formed between a portion of the spring follower 63 and the second detent 59*b* of the base member 51 when the second elongate member 50 is in the operational position. The gap 67 may exist due to the stop surface 59*c* being formed such that the stop surface contacts the end of the spring follower 63 and prevents the base member 51 from rotating to the point where the second detent 59*b* is parallel with the portion of the spring follower that the second detent contacts. In such embodiments, as a result of the fourth radius $R_4$ defined by the second detent 59*b* being less than the third radius $R_3$ of the cam surface 55, the second elongate member 50 may be biased such that the stop surface 59*c* will be forced into contact with the end of the spring member 63. In alternate embodiments, the spring follower may be parallel to the second detent when the stop surface contacts the end of the spring follower such that no gap is formed between the spring follower and the second detent when the second elongate member is in the operational position.

Rotation of the elongate member 50 in a second direction back to the storage position illustrated in FIG. 7 is resisted by the third radius $R_3$ defined by the cam surface being larger than the fourth radius $R_4$ defined by the second detent 59*b*, and hence rotation in the second direction would require overcoming additional resistance created by the spring follower 63, similarly as to that described above with respect to the first detent 59*a*. Although the second elongate member 50 has been described as having first 59*a* and second 59*b* detents, the base member 51 may comprise a single detent, additional detents, or no detents at all in alternate embodiments. The above-description is also applicable in a similar manner to the first elongate member 48, but will not be discussed in detail for the sake of brevity.

As noted above, the multipurpose tool 10 can include a bit driver 22 for engaging corresponding bits 23, such as screwdriver bits, torx bits, hex bits, Robertson bits, etc. Accordingly, the multipurpose tool of one embodiment is configured to store at least one bit in instances in which the bit is not engaged by the bit driver. As such, extra bits, i.e., bits that are not currently engaged by the bit driver, can be stored by the multipurpose tool 10 itself in order to avoid misplacement of the extra bits. As shown in FIG. 1, for example, a sleeve 56 may be coupled to a first side A (see sides A and B defined in FIG. 8) of the first handle 12' and defining a longitudinal axis, wherein the sleeve is configured to receive a removable bit 23' along the longitudinal axis. The sleeve 56 may comprise an integral part of the first handle 12' in some embodiments. For example, the sleeve 56 is illustrated as being defined by a projection extending from the first handle 12', which is bent or otherwise formed into an angled member configured to receive a bit. Thus, the sleeve 56 may be formed partially or entirely from the first handle 12', which may reduce the weight, complexity, and/or cost of the multipurpose tool 10. The sleeve 56 may be configured to substantially prevent movement of the removable bit 23' in a plurality of directions other than a first axial direction and a second axial direction along the longitudinal axis of the sleeve. A bit stop may be positioned along the axis and configured to limit travel of the removable bit 23' in the first axial direction. The bit stop may comprise an integral part of the sleeve 56, a separate member, or it may alternatively comprise the first base member 49. Further, a displaceable button 58 may be configured to selectively limit movement of the removable bit 23' in the sleeve 56 in the second axial direction along the axis. The displaceable button 58 may be moveable between a retracted (i.e. depressed) position wherein the displaceable button is displaced in a direction generally from side A toward side B wherein movement of the removable bit 23' along the longitudinal axis is allowed, and an extend position (illustrated) wherein movement of the removable bit along the longitudinal axis in the second axial direction is limited.

Figure 11:
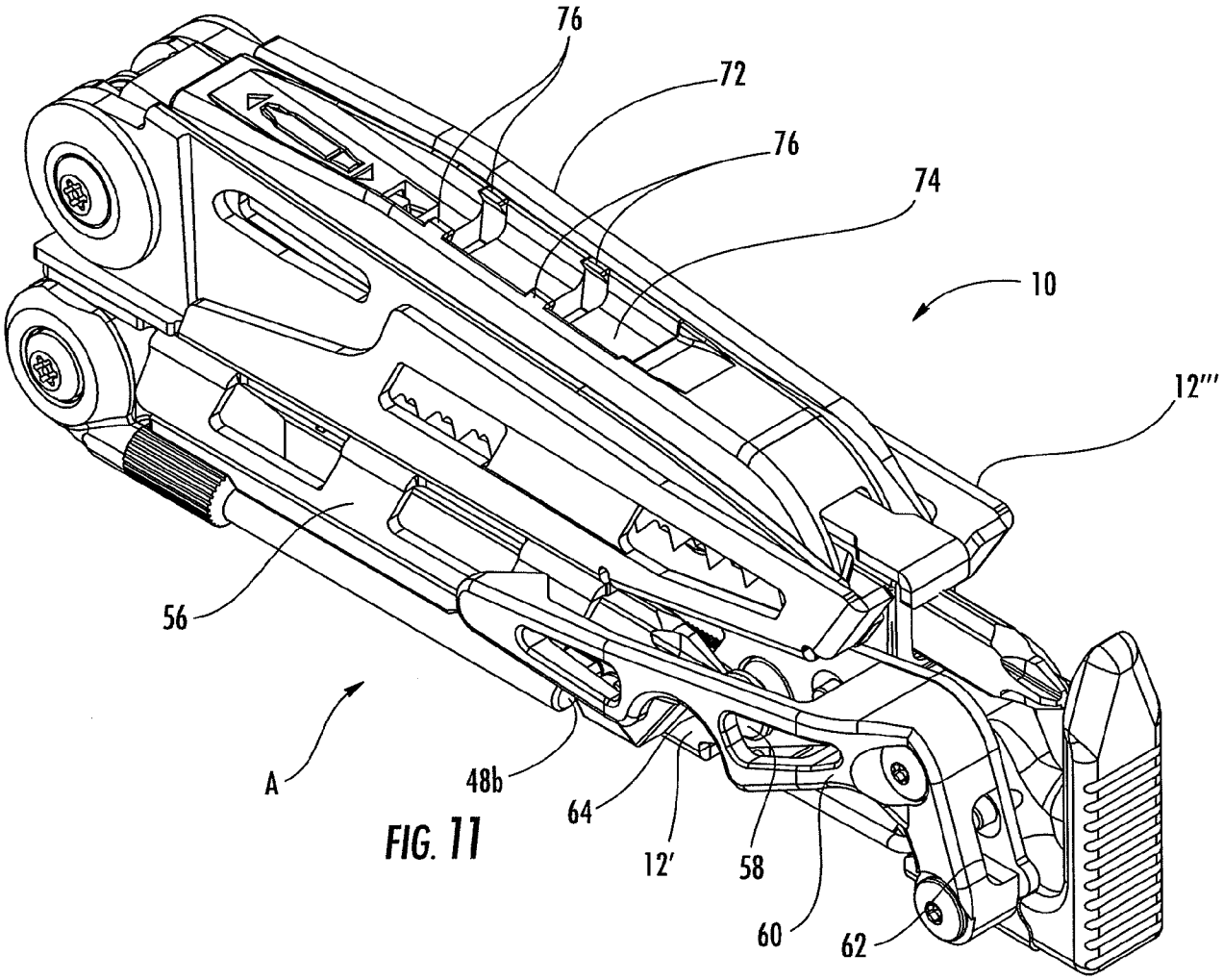
FIG. 11 illustrates a perspective view of side A of the multipurpose tool of FIG. 2 in the closed position.

As illustrated in FIG. 11, the multipurpose tool 10 may further comprise a clip 60 coupled to the first handle 12'. The clip 60 may be useful for attaching the multipurpose tool 10 to a belt, pocket, or other object. The clip 60 may comprise a titanium material, which resists bending while avoiding adding significant weight to the multipurpose tool 10. Additionally, the clip 60 may also be removable in order decrease the overall dimensions and weight of the multipurpose tool 10, or to allow for replacement of the clip in the unlikely event that the clip is damaged. Further, the clip 60 may comprise single piece of material or multiple pieces of material. The clip defines a bit aperture 62 substantially coaxial with longitudinal axis defined by the sleeve 56. The bit aperture 62 may thus be configured to receive the removable bit 23' during insertion of the removable bit into the sleeve 56 and during removal of the removable bit from the sleeve. The clip 60 may further comprise a button cutout 64 configured to facilitate access to the displaceable button 58, and thus facilitate removal and insertion of the removable bit 23'.

Additionally, as illustrated in FIGS. 2 and 7, the multipurpose tool 10 may further comprise a second sleeve 66 coupled to the second side B, substantially opposite to the first side A, of the first handle 12' and defining a second longitudinal axis substantially parallel with the longitudinal axis of the sleeve 56. Similarly to the first sleeve 56, the second sleeve 66 may also be integral with the first handle 12' as described above. The second sleeve 66 is configured to receive a second removable bit 23". In this embodiment the displaceable button 58 may be configured to limit movement of the second removable bit 23" along the second longitudinal axis when the displaceable button is in the retracted position and the extended position. However, the displaceable button 58 may allow movement of the second removable bit 23" along the second longitudinal axis when the displaceable button is in a second extended position wherein the displaceable button is displaced in a direction generally from side B toward side A past the extended position.

Thus, in summary, when the displaceable button 58 is in the extended position, both the removable bit 23' and the second removable bit 23" may be retained in the respective sleeves 56, 66. However, when the displaceable button 58 is moved to the retracted position, the removable bit 23' may be removed from the sleeve 56, whereas the second removable bit 23" will be retained in the second sleeve 66 by the displaceable button. Conversely, when the displaceable button 58 is moved to the second extended position, the second removable bit 23" may be removed from the second sleeve 66, whereas the removable bit 23' will be retained in the sleeve 56 by the displaceable button. Accordingly, access to the bits 23 may be selectively controlled by selecting the position of the displaceable button 58.

Figure 12:
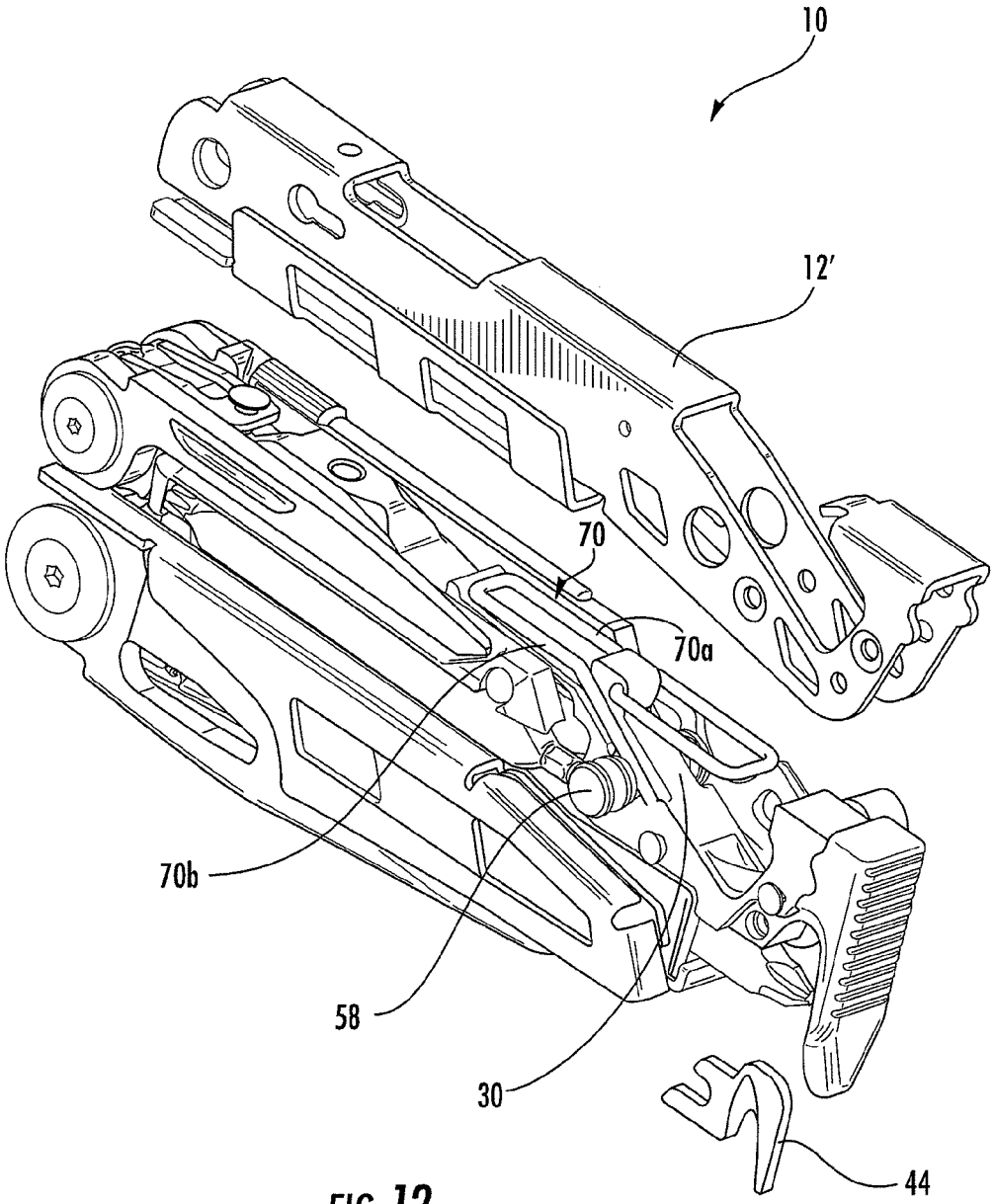
FIG. 12 illustrates an exploded view of the multipurpose tool according to one embodiment of the present invention.
Figure 13:
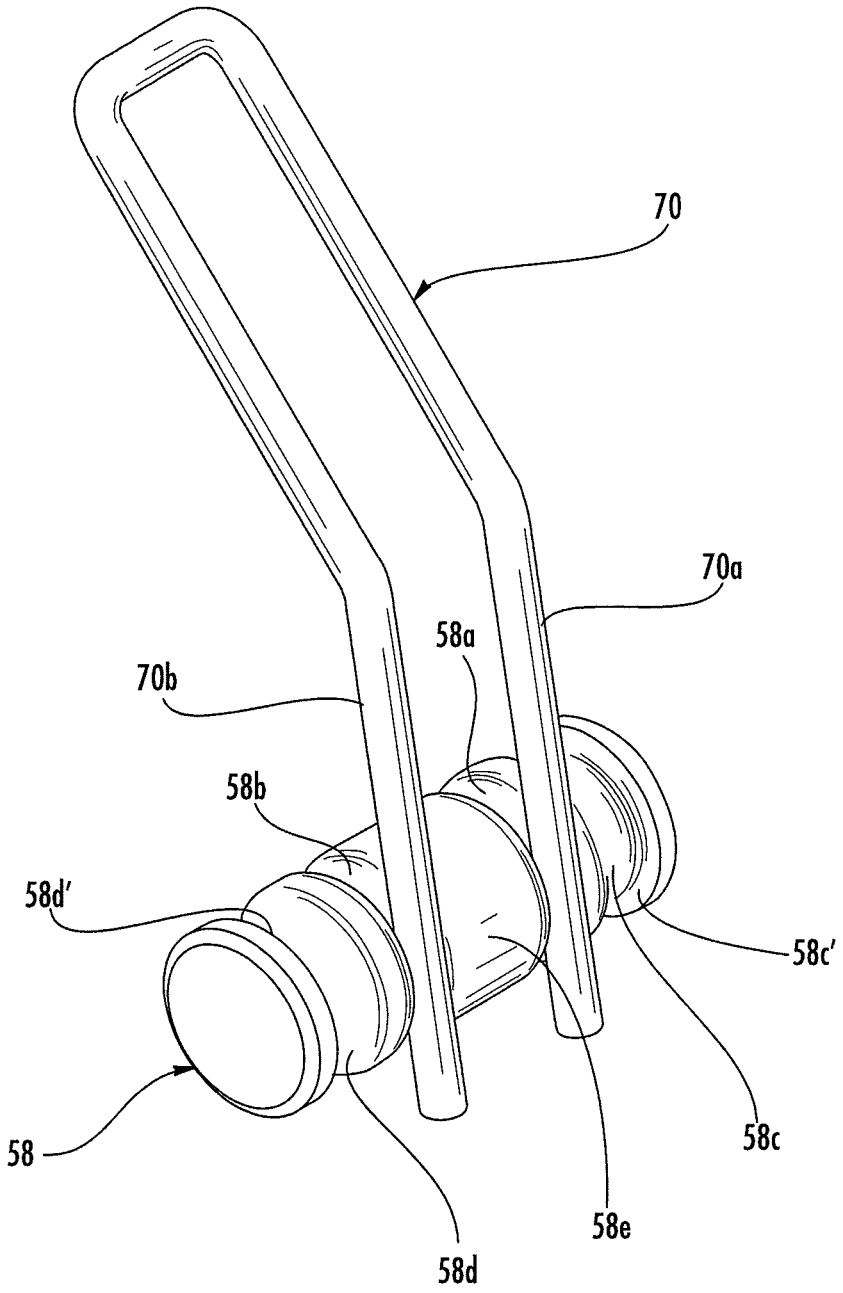
FIG. 13 illustrates a perspective view of the spring and displaceable button of FIG. 12.

A variety of different types of mechanisms may be employed to allow the displaceable button 58 to operate as described above. However, one embodiment of a mechanism configured to operate in this manner is illustrated in FIGS. 12-13. FIG. 12 illustrates an exploded view of the multipurpose tool 10 with the first handle 12' removed for clarity purposes. As shown, one embodiment of the multipurpose tool 10 uses a spring 70 in conjunction with the displaceable button 58. The spring 70 is positioned such that it is retained in place by the body member 30 and the first handle 12'. In particular, first 70*a* and second 70b prongs of the spring 70 wrap around opposite sides of the body member 30. When the multipurpose tool 10 is fully assembled, the first handle 12' will be positioned around the spring 70 such that the spring is thereby retained between the first handle and the body member 30.

In terms of the relationship of the spring 70 with the displaceable button 58, FIG. 13 illustrates the interaction of the spring with the displaceable button when the displaceable button is in the extended position. The other parts of the multipurpose tool 10 have been removed in this view for clarity purposes. As illustrated, when in the extended position, the first prong 70*a* engages a first inner groove 58*a* defined in the displaceable button 58 and the second prong 70*a* engages a second inner groove 58*b* defined in the displaceable button. The first 70*a* and second 70*b* prongs thus interact with the first 58*a* and second 58*b* inner grooves to retain the displaceable button in the extended position. However, the multipurpose tool 10 includes empty space opposite the displaceable button 58 from the spring 70 within the first handle 12' which allows the first 70*a* and second 70*b* prongs to deflect when the displaceable button is pushed along its longitudinal axis. Thus, the displaceable button 58 may be moved to either of the retracted position or the second extended position, as described above.

To reach the retracted position, the user would push the displaceable button 58 generally to the left along the longitudinal axis of the displaceable button, as viewed from the perspectives illustrated in FIGS. 12 and 13. When the displaceable button 58 is moved to the retracted position, the first prong 70*a* deflects as it is forced out of the first inner groove 58*a* and then engages the first outer groove 58c. At the same time the second prong 70*b* deflects as it is forced out of the second inner groove 58*b* and then rests on the center cylindrical portion 58*e* of the displaceable button 58. Note that during all of these operations and those described below, the spring 70 essentially remains stationary with the exception of the deflections of the first 70*a* and second 70*b* prongs towards and away from the displaceable button 58 which deflect as they move in and out of the grooves 58*a-d*. The spring 70 is generally restrained from other movement due to each prong 70*a*, 70*b* being positioned between the body member 30 and the first handle 12'.

Once the displaceable spring 58 is in the retracted position, the bit 23' may be removed or inserted into the sleeve 56. Thereafter it may be desirable to restrain the bit 23' in the sleeve 56. In order to accomplish this, the displaceable button 58 would be pushed by the user back to the extended position, generally to the right along the longitudinal axis of the displaceable button 58 as illustrated in FIGS. 12 and 13, whereby the first prong 70*a* moves from the first outer groove 58*c* back to the first inner groove 58*a*, and the second prong 70*b* slides along the center cylindrical portion 58*e* and returns to the second inner groove 58*b*. Thereafter it may further be desirable to allow access to the second sleeve 66 such that the bit 23" may be removed or inserted into the second sleeve. Accordingly, the user pushes the displaceable button 58 further to the right along the longitudinal axis of the displaceable button 58, in terms of the perspective illustrated in FIGS. 12 and 13, to reach the second extended position. As the displaceable button 58 travels from the extended position to the second extended position, the second prong 70*b* will deflect as it is forced out of the second inner groove 58*b*, and then engage the second outer groove 58*d*. At the same time, the first prong 70*a* deflects as it is forced out of the first inner groove 58*a* and then rests on the center cylindrical portion 58*e* of the displaceable button 58. In this second extended position, the bit 23" may be either removed or inserted into the second sleeve 66. To return the displaceable button 58 to the extended position, the user pushes on the button generally to the left along the longitudinal axis of the displaceable button, such that the first prong 70*a* returns to the first inner groove 58*a*, and the second prong 70*b* returns to the second inner groove 58*b*.

Notably, the displaceable button 58 may comprise two additional features which were not discussed above. One such feature is that the first outer groove 58*c* and the second outer groove 58*d* respectively comprise first 58*c'* and second 58*d'* flat end surfaces. The flat end surfaces 58*c'*, 58*d'* are configured to prevent the displaceable button 58 from extending past the retracted and second extended positions whereby the displaceable button could possibly fall out of the multipurpose tool 10. In particular, the first 70*a* and second 70*b* prongs contact the flat end surfaces 58*c'*, 58*d'* and stop, as opposed to deflecting and allowing the displaceable button 58 to move further. This is in contrast to the generally tapered shapes defined by the other portions of the grooves 58*a-d* which allow the movement described above.

The second additional feature is that the displaceable button 58 may be easier to move from the retracted and second extended positions to the extended position than it is to move the displaceable button out of the extended position. This is because when the displaceable button 58 is in the extended position, both the first prong 70*a* and the second prong 70*b* engage a respective groove 58*a*, 58*b* in the displaceable button. However, when the displaceable button 58 is in either of the retracted or second extended position, the prongs will only engage one groove. For example, when the displaceable button 58 is in the retracted position, only the first prong 70*a* engages a groove (the first outer groove 58*c*), whereas the second prong 70*b* will rest on the center cylindrical portion 58*e*, and thereby does not add significant additional resistance to movement of the displaceable button. Similarly, when the displaceable button 58 is in the second extended position, only the second prong 70*b* engages a groove (the second outer groove 58*d*), whereas the first prong 70*a* will rest on the center cylindrical portion 58*e*, and thereby does not add significant additional resistance to movement of the displaceable button. Accordingly, the displaceable button 58 may advantageously be more difficult to move out of the extended position, which may be preferable because the extended position retains both of the bits 23', 23" in the respective sleeves 56, 66.

In some embodiments the multipurpose tool 10 may comprise additional storage for removable bits. As used herein, removable bits are broadly defined to include a variety of tools and items which may be selectively held by the multipurpose tool. Thus removable bits can include the illustrated bits 23, though other items such as fire starter kits, compasses, and other tools and items which can be selectively held by the multipurpose tool 10 are included within the meaning of this term. As illustrated in FIG. 11, one embodiment of the multipurpose tool 10 includes a handle cover 72 coupled to the second handle 12". The handle cover 72 defines an ergonomic shape which may make the multipurpose tool 10 more comfortable to use. Further, the handle cover 72 may define a longitudinal channel 74 configured to receive a removable bit. The handle cover 72 and the removable bit may collectively define a handgrip when the removable bit is received in the longitudinal channel 74. When a removable bit is not received in the longitudinal channel, the handle cover 72 may define a handgrip by itself. The handle cover 72 may also comprise one or more fingers 76 which extend into the longitudinal channel 74. Thus, when a removable bit slides into the longitudinal channel 74, the fingers 76 are configured to engage the removable bit to selectively retain the removable bit therein by providing an interference fit with the removable fit or acting as spring elements which apply a spring force to the removable bit to hold it therein.

Figure 14:
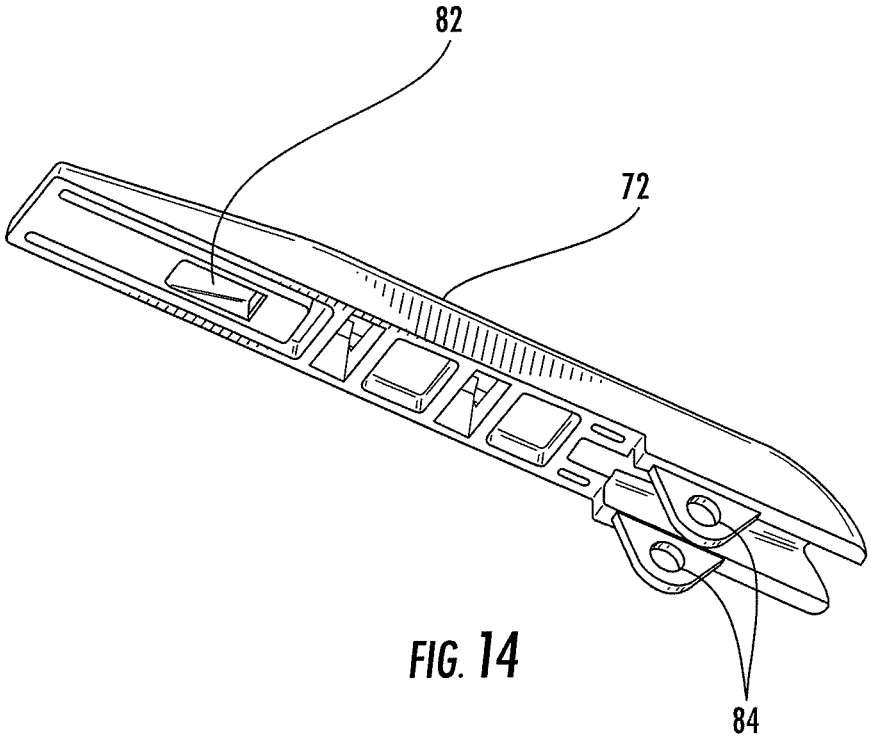
FIG. 14 illustrates a perspective view of the handle cover according to one embodiment of the present invention.
Figure 15:
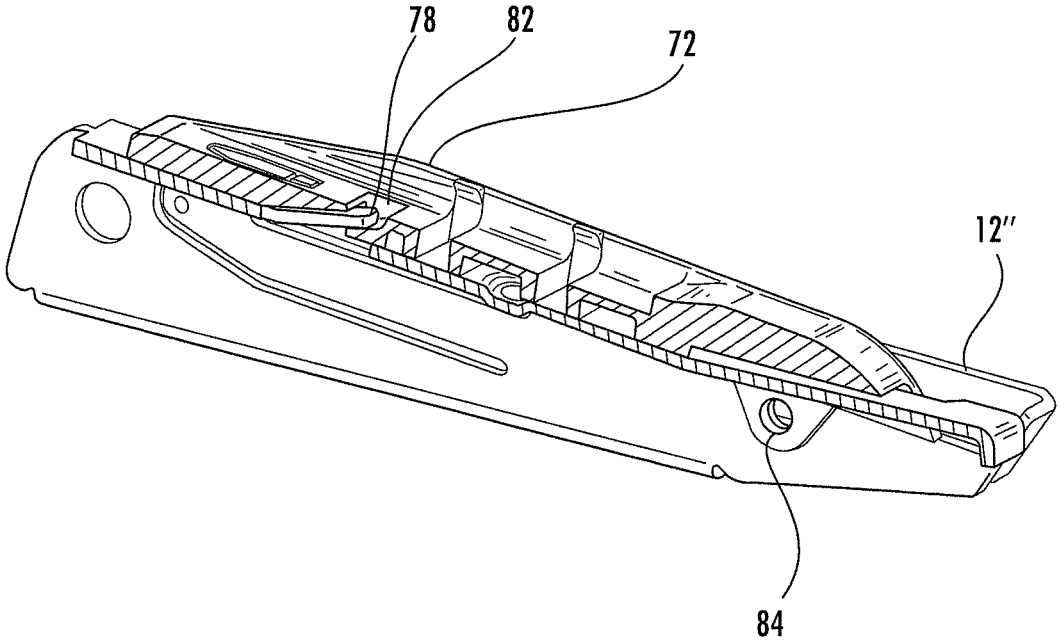
FIG. 15 illustrates a sectional view through the handle cover and second handle according to one embodiment of the present invention.

The handle cover 72 may be coupled to the second handle 12" in a variety of manners. In the illustrated embodiment, the handle cover 72 is coupled to the second handle 12" using a configuration which simplifies attachment while providing a substantially secure connection. In particular, as illustrated in FIG. 6 the second handle 12" comprises an integral tang 78 which is displaced from a corresponding aperture 80 in the second handle and extends at an angle outwardly from the second handle. As illustrated in FIG. 14, the handle cover 72 comprises a recess 82 configured to receive the tang 78. The coupling of the handle cover 72 to the second handle 12" is shown in the sectional view illustrated in FIG. 15. As illustrated, when the tang 78 slides into the recess 82, the handle cover 72 is at least partially coupled to the second handle 12". A second point of attachment, such as a bolt extending through the handle cover 72 and the second handle 12" could further secure the handle cover to the handle, such as through one or more holes 84 in the handle cover. Accordingly, a secure attachment of the handle cover 72 to the second handle 12" may be effectuated.

Figure 16:
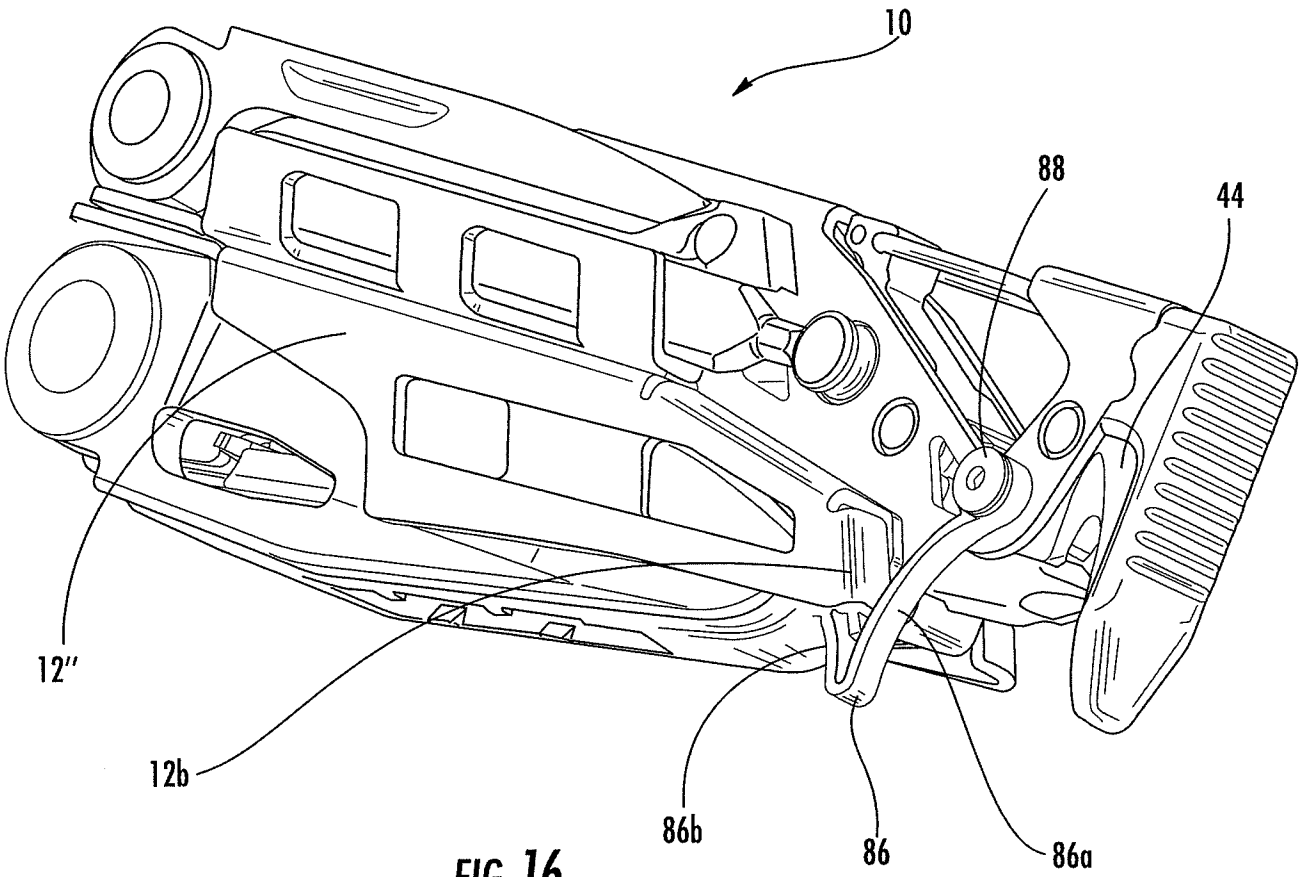
FIG. 16 illustrates a perspective view of the multipurpose tool with a latch according to one embodiment of the present invention.

In an additional embodiment, the multipurpose tool 10 may comprise a latch 86 configured to selectively retain the multipurpose tool in the closed position, as illustrated in FIG. 16. In the illustrated embodiment the latch 86 selectively couples the first handle 12' to the second handle 12" to thereby hold the multipurpose tool 10 in the closed configuration. While many different configurations are possible, the illustrated embodiment of the latch 86 attaches to and pivots about a retaining member 88, and which may comprise a screw or pin in some embodiments. The retaining member 88 also holds the blade 44 in place, although in other embodiments the retaining member may couple other tools to the first handle 12'. The latch 86 comprises an end tab 86*b* which engages the end 12*b* of the second handle 12". In particular, the latch 86 and/or the end 12*b* of the second handle 12" may deflect slightly to allow the latch and the end of the second handle to interfere such that the latch securely engages the end of the second handle to thereby resist accidental opening of the multipurpose tool 10. In some embodiments the latch 86 comprises a single bent piece of metal, such as a bent piece of sheet metal. Accordingly, the latch 86 may define a lightweight structure with simplified construction.

The latch 86 may be secured and released by one hand. For example, the user may close the latch 86 by squeezing the latch to thereby apply pressure to a main arm 86*a* of the latch. Thereafter, to allow the multipurpose tool 10 to open, the user may flick the latch 86 open with the nail side of the thumb to thereby apply a force to a end tab 86*b* of the latch, which releases it. Accordingly, operation of the latch 86 may be simplified while providing a secure way to retain the multipurpose tool 10 in the closed position when desired.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multipurpose tool comprising:

a plurality of handles comprising a first handle and a second handle configured for relative movement between a closed position and an open position;

a plurality of tools carried by at least one of the handles; and a pair of pliers defined by a first jaw coupled to the first handle and a second jaw coupled to the second handle;

wherein the first jaw defines a receiving aperture, wherein the receiving aperture is threaded, and wherein an exterior surface of the second handle in the open position defines an opening that opens through an end of the second handle to which the second jaw is coupled, wherein another exterior surface of the second handle in the closed position defines an opening that is configured to align with the receiving aperture when the multipurpose tool is in the closed position, wherein the receiving aperture is configured to receive and engage an accessory member such that the accessory member extends outwardly from the first jaw through the opening defined by the second handle when the multipurpose tool is in the closed position.

2. The multipurpose tool of claim 1, wherein the pair of pliers define a crimping aperture between the first jaw and the second jaw.

3. The multipurpose tool of claim 1 wherein the first handle extends in a lengthwise direction, wherein the multipurpose tool further comprises a body member coupled to the first handle, and wherein the body member defines an impact surface proximate one end of the multipurpose tool that is configured to withstand impact and that extends perpendicularly to the first handle.

4. The multipurpose tool of claim 3 further comprising a bit driver coupled to the second handle, wherein the bit driver comprises a bit chamber defining an opening configured to receive a bit along an axis, and wherein the body member overlaps with the second handle when the multipurpose tool is in the closed position such that the body member intersects the axis to thereby prevent the bit from falling out of the bit chamber when the multipurpose tool is in the closed position.

5. The multipurpose tool of claim 3 wherein the impact surface comprises a plurality of ribs.

6. The multipurpose tool of claim 3 wherein the first handle comprises a pair of sidewalls, and wherein the body member is positioned at least partially between the sidewalls of the first handle.

7. The multipurpose tool of claim 6 wherein the body member comprises first and second overhanging portions that overlap with respective sidewalls of the first handle.

8. The multipurpose tool of claim 3, further comprising a carabiner, wherein the carabiner is defined at least in part by the body member.

9. The multipurpose tool of claim 8 wherein the carabiner comprises a pair of sidewalls, and wherein the body member is positioned at least partially between the sidewalls of the carabiner.

10. The multipurpose tool of claim 9 wherein the body member comprises first and second overhanging portions that overlap with respective sidewalls of the carabiner.

11. The multipurpose tool of claim 1, further comprising:
a body member coupled to the first handle; and
an actuation extension defined by the body member and configured to engage a bolt mechanism of a firearm when the multipurpose tool is in the closed position.

12. The multipurpose tool of claim 11 further comprising a bit driver coupled to the second handle, wherein the bit driver comprises a bit chamber defining an opening configured to receive a bit along an axis, and wherein the body member overlaps with the second handle when the multipurpose tool is in the closed position such that the body member intersects the axis to thereby prevent the bit from falling out of the bit chamber when the multipurpose tool is in the closed position.

13. The multipurpose tool of claim 1, further comprising:
a body member coupled to the first handle;
a pocket defined between the first handle and the body member; and
a blade positioned in the pocket,
wherein the blade is at least partially retained in the pocket by a retaining member extending at least partially through the blade and at least partially through the first handle or the body member.

14. The multipurpose tool of claim 13 further comprising a bit driver coupled to the second handle, wherein the bit driver comprises a bit chamber defining an opening configured to receive a bit along an axis, and wherein the body member overlaps with the second handle when the multipurpose tool is in the closed position such that the body member intersects the axis to thereby prevent the bit from falling out of the bit chamber when the multipurpose tool is in the closed position.

15. The multipurpose tool of claim 1 further comprising:
a bit driver coupled to the handle, wherein the bit driver comprises a bit chamber configured to receive a bit; and
a bit retention spring movable between a locking position wherein the bit retention spring is configured to engage a recess in the bit, and a release position wherein the bit retention spring is configured to disengage from the recess,
wherein the bit retention spring is integral with the handle.

16. The multipurpose tool of claim 1 wherein the first handle comprises a projection defining a sleeve on a first side of the first handle, wherein the sleeve defines a longitudinal axis, wherein the sleeve is configured to receive a removable bit along the longitudinal axis, and wherein the multipurpose tool further comprises a bit stop positioned along the longitudinal axis and configured to limit travel of the removable bit.

17. The multipurpose tool of claim 1 further comprising:
a handle cover coupled to the second handle, the handle cover defining a longitudinal channel configured to receive a removable bit,
wherein the handle cover and the removable bit collectively define a handgrip when the removable bit is received in the longitudinal channel.

18. The multipurpose tool of claim 1 further comprising:
a latch coupled to the first handle,
wherein the latch is configured to deflect to releasably engage the second handle when the first handle and the second handle are in the closed position to selectively retain the multipurpose tool in the closed position.

19. The multipurpose tool of claim 1, wherein the opening defined by the second handle is not aligned with the receiving aperture when the multipurpose tool is in the open position.

20. The multipurpose tool of claim 1, wherein the receiving aperture is defined by a portion of the first jaw that extends beyond the first handle in the open position.

21. The multipurpose tool of claim 1, wherein the first and second jaws are pivotably connected to one another at a pivot point, and wherein the receiving aperture is defined by a portion of the first jaw that extends beyond the pivot point relative to the handles in the open position.

22. A multipurpose tool comprising:
a plurality of handles comprising a first handle and a second handle configured for relative movement between a closed position and an open position;
a plurality of tools carried by at least one of the handles; and
a pair of pliers defined by a first jaw coupled to the first handle and a second jaw coupled to the second handle;
wherein the first jaw defines a receiving aperture, and
wherein the second handle defines an opening that is configured to align with the receiving aperture when the multipurpose tool is in the closed position,
wherein the receiving aperture is configured to receive an accessory member, and wherein the accessory member is a barrel cleaning rod.

23. A multipurpose tool comprising:
a plurality of handles comprising a first handle and a second handle configured for relative movement between a closed position and an open position;
a plurality of tools carried by at least one of the handles; and
a pair of pliers defined by a first jaw coupled to the first handle and a second jaw coupled to the second handle;
wherein the first jaw defines a receiving aperture, wherein the first jaw includes an inner surface configured to contact the second jaw when the multipurpose tool is in the open position, and wherein the receiving aperture is defined by the first jaw to open through an exterior surface, opposite the inner surface; and wherein an exterior surface of the second handle in the open position defines an opening that opens through an end of the second handle to which the second jaw is coupled, wherein another exterior surface of the second handle in the closed position defines an opening that is configured to align with the receiving aperture when the multipurpose tool is in the closed position, wherein the receiving aperture is configured to receive an accessory member.

* * * * *